US006428353B2

(12) United States Patent
Mochizuki

(10) Patent No.: US 6,428,353 B2
(45) Date of Patent: Aug. 6, 2002

(54) CONNECTOR SUPPORT MECHANISM FOR INTERCONNECTING CONNECTORS

(75) Inventor: Shinji Mochizuki, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/895,216

(22) Filed: Jul. 2, 2001

(30) Foreign Application Priority Data

| | | |
|---|---|---|
| Jul. 3, 2000 | (JP) | 2000-201080 |
| Jul. 7, 2000 | (JP) | 2000-207137 |
| Jul. 7, 2000 | (JP) | 2000-207167 |
| Jul. 11, 2000 | (JP) | 2000-210417 |
| Jul. 11, 2000 | (JP) | 2000-210479 |
| Jul. 11, 2000 | (JP) | 2000-210480 |

(51) Int. Cl.[7] ..... H01R 13/73

(52) U.S. Cl. ..... 439/545; 439/157; 439/247; 439/342; 439/372

(58) Field of Search ..... 439/545, 247, 439/157, 342, 372

(56) References Cited

U.S. PATENT DOCUMENTS 5,263,871 A * 11/1993 Sano ..... 439/157
5,476,391 A * 12/1995 Katsuma ..... 439/157

FOREIGN PATENT DOCUMENTS

| | | | |
|---|---|---|---|
| JP | 11-003746 | * | 1/1999 |
| JP | 11-111386 | * | 4/1999 |
| JP | 2001-23724 | * | 1/2001 |
| JP | 2001-23725 | * | 1/2001 |
| JP | 2001-23726 | * | 1/2001 |

* cited by examiner

*Primary Examiner*—Tho D. Ta
*Assistant Examiner*—Truc Nguyen
(74) *Attorney, Agent, or Firm*—Finnegan, Henderson, Farabow, Garrett, & Dunner, L.L.P.

(57) ABSTRACT

A connector support mechanism includes a female connector (4) and a male connector (5). A cam lever (27) formed with a cam groove (43) which guides a boss (21) protruding from the female connector (4) is turnably pivoted by the male connector (5). In a state in which the boss (2) is inserted into the cam groove (43), if the cam lever (27) turns, the female connector (4) and the male connector (5) are fitted to each other. The bracket (3) is provided with a resilient temporarily locking arm (14) which abuts a rear side surface of the boss (21) of the female connector (4). Therefore, a fitting load can be reduced by the function of the cam lever (27), and a structure of the female connector (4) which is temporarily locked to the bracket (3) can also be simplified.

8 Claims, 22 Drawing Sheets

CONNECTOR SUPPORT MECHANISM FOR INTERCONNECTING CONNECTORS

BACKGROUND OF THE INVENTION

1. Field of the Invention

The present invention relates to a connector support mechanism, and more particularly, to a connector support mechanism comprising a pair of male and female connectors to be connected to each other and having a structure in which one of the connectors is temporarily locked to a mounted body.

2. Description of the Related Arts

As a connector of this kind, a connector described in Japanese Patent Application Laid-Open No. 2001-23725 is known (see FIG. 1). In this connector, a rear end of a first connector 52 is supported by an instrument panel 51, and a second connector 53 is fitted to the first connector 52 from its front end side. Engaging levers 54 and 54 are turnably pivoted on the first connector 52. A rear abutting protrusion 55 abutting a back surface of the instrument panel 51 and a front abutting protrusion 56 abutting a front surface of the instrument panel 51 are formed on a free end of each of the engaging levers 54 and 54. Further, a lever turning protrusion 57, which a front end surface of the second connector 53 abuts, protrudes from the engaging lever 54.

Therefore, when the second connector 53 is fitted to the first connector 52, a front end surface of the second connector 53 pushes the lever turning protrusion 57, so as to turn the engaging lever 54. To separate both the connectors 52 and 53 from each other from a state shown in FIG. 1, the second connector 53 is pulled backward. With this pull operation, the rear abutting protrusion 55 receives a reaction force from the instrument panel 51 so as to turn the engaging lever 54, and the fitted state of both the connectors 52 and 53 is released.

In the above-described conventional connectors, however, when the fitted state is released, the rear abutting protrusion 55 abuts the back surface of the instrument panel 51 diagonally, and this angle θ1 is greater than 90° with respect to the pull-out direction (backward) of the second connector 53. Therefore, when the second connector 53 was pulled backward, the component of force for turning the engaging lever 54 becomes small, and there is a problem that the pull-out force can not be converted into a turning force efficiently.

Further, there is a known connector shown in FIG. 2 as described in Japanese Patent Application Laid-Open No. 11–3746. As shown in FIG. 2, this connector comprises a first connector 51, a second connector 52 and a guide member 53 for accommodating the first connector 51. The guide member 53 includes locking means 53C for holding the first connector 51, and has a function that guiding the second connector 52 toward the first connector 51. A rib 53B protrudes inward from a side wall 53A of the guide member 53. A cam protrusion 51A protrudes from the first connector 51. The second connector 52 is formed with a straight guide groove 54 for guiding the cam protrusion 51A. A rotation plate 55 formed with a cam groove 55A is pivotally supported on the second connector 52 by means of a support shaft 56. Two lever protrusions 57A and 57B protrude from the rotation plate 55.

According to this connector, if the second connector 52 is allowed to approach the first connector 51 held by the guide member 53, the lever protrusion 57A of the rotation plate 55 abuts the rib 53B to turn the rotation plate 55, so that the cam protrusion 51A is pulled into the cam groove 55A, and the first connector 51 and the second connector 52 are fitted to each other. On the other hand, in order to release the fitted state between these connectors, the second connector 52 is retreated and the lever protrusion 57B abuts the rib 53B to rotate the rotation plate 55 in the opposite direction, thereby applying a force for separating the cam protrusion 51A in the cam groove 55A from the support shaft 56, so that the fitted state between both the connectors 51 and 52 is released. The cam groove 55A of the rotation plate 55 has a function for forcibly bringing the cam protrusion 51A toward or away from the support shaft 56. Portion at which the rib 53B formed on the side wall 53A of the guide member 53 abuts the lever protrusions 57A and 57B, function as a point of force. Therefore, when the lever protrusions 57A and 57B abut the rib 53B, there is an adverse possibility that bending is generated in the rib 53B. Such a bending of the rib 53B generates a bending return when the turning operation of the rotation plate 55 is completed. Therefore, there are problems that the bending return hinders proper operation of the cam groove 55A so that smooth fitting operation or fitting-releasing operation can not be carried out, and a load is applied to the fitted connectors. Thus, it is necessary to enhance the strength of the rib 53B of the guide member 55.

Further, there is a known connector shown in FIGS. 3 and 4 as described in Japanese Patent Application Laid-Open No. 11–111386. This connector comprises two connectors, i.e., one connector 51 accommodated in a holder 50 and the other connector 52 which is fitted to the one connector 51. If the other connector 52 is fitted to the one connector 51, the one connector 51 releases a locked state by locking means 53 formed on the holder 50, and the one connector 51 is released from the holder 50. This connector has a fitting ensuring function capable of confirming that both the connectors 51 and 52 are fitted to each other if the one connector 51 is released from the holder 50.

In this connector, however, when the one connector 51 and the other connector 52 are fitted to each other, since there is no mechanism for reducing an insertion force caused when both the connectors are fitted to each other, this connector requires skill and relatively great force in the fitting operation. Further, since the one connector 51 is temporarily locked to the holder 50, it is necessary to form the locking means 53 on the one connector 51, and to form a recess for locking the locking means 53 to the inner wall surface of the holder 50. Therefore, there is a problem that the structure of the holder 50 and the C51 is complicated.

SUMMARY OF THE INVENTION

It is an object of the present invention to provide a connector support mechanism capable of reducing an insertion force required for fitting connectors, and simplifying a structure of a mounted body and the connector which is temporarily locked.

The first aspect of the invention provides a connector support mechanism comprising: a first connector which is temporarily locked to a mounted member and which is provided with a guided protrusion protruding from the first connector; and a second connector turnably supporting a cam lever formed with a cam groove which guides the guided protrusion; wherein the first connector and the second connector are fitted to each other by inserting the guided protrusion of the first connector into the cam groove and turning the cam lever in that state, and wherein the mounted body is provided with a resilient temporarily locking arm for temporarily locking the first connector to the mounted body, and the temporarily locking arm abuts the guided protrusion.

According to the first aspect of the invention, in a state in which a guided protrusion protruding from a first connector is inserted into a cam groove, if a cam lever is turned, the first connector and a second connector can be fitted to each other. A temporarily locking arm formed on the side of a mounted body has resiliency and holds the first connector by the resilient force, and abuts the guided protrusion, thereby preventing the first connector from being retreated when the second connector is pushed against the first connector. Therefore, the guided protrusion which is guided by the cam groove and used for fitting both the connectors to each other functions as an abutment portion of the temporarily locking arm. Thus, it is unnecessary to separately provide a structure for engaging the temporarily locking arm to the first connector, and a structure of the first connector can be simplified.

The second aspect of the invention provides a connector support mechanism according to the first aspect of the invention, wherein in a state in which the guided protrusion is inserted into the cam groove, the cam lever is turned as the second connector moves in a fitting direction, thereby releasing the temporarily locking state between the first connector and the mounted body.

According to the second aspect of the invention, by turning the cam lever, the temporarily locked state between the first connector and the mounted body is released. As a result, the first connector is released from the mounted body in a state in which the fitting operation between the first connector and second connector is started. Therefore, it is possible to increase the turning angle and to reduce the fitting load in a state in which the cam lever does not receive limitation from the mounted body side. Further, since the first connector is released from the mounted body, vibration from the mounted body side is not transmitted to the first connector, and effect of relative vibration caused by weight difference between the mounted body and the second connector can be prevented.

The third aspect of the invention provides a connector support mechanism according to the first aspect of the invention, wherein the mounted body is a substantially cylindrical bracket fixed to an opening of a plate body and having a cylindrical hole which is in communication with the opening, and wherein the temporarily locking arm stands on a cylindrical inner surface of the bracket diagonally forwardly.

According to the third aspect of the invention, an opening is formed in a plate such as an instrument panel of an automobile, and a substantially cylindrical bracket is mounted to the opening. Therefore, it is possible to easily form the mounted body which temporarily locks the first connector. Further, it is possible to easily mount the first connector by the temporarily locking arm having resiliency formed on a cylindrical inner surface of the bracket. That is, by inserting the first connector into the bracket from front side to back side, the guided protrusion of the first connector can ride over in a state in which the temporarily locking arm is bent outward. After the guided protrusion passed forward, the temporarily locking arm returns such as to abut the side surface of the first connector by the resilient force, and the tip end of the temporarily locking arm abuts the rear side surface of the guided protrusion. At that time, the retreat movement of the first connector is restricted by the tip end of the temporarily locking arm. Therefore, when the second connector starts fitting, the guided protrusion can be inserted into the cam groove.

The fourth aspect of the invention provides a connector support mechanism according to the first aspect of the invention, wherein the cam lever has a turning operation member which abuts the mounted body, and wherein the mounted body includes a locking step for locking the turning operation member.

According to the fourth aspect of the invention, by abutting the turning operation member against the locking step of the mounted body, the pushing force of the second connector into the fitting direction can be converted into the rotation force of the cam lever, and both the connectors can be fitted to each other.

The fifth aspect of the invention provides a connector support mechanism according to the first aspect of the invention, wherein in a state in which the cam lever captures the first connector, the cam lever turns as the cam lever moves in the fitting direction of the second connector, thereby locking the turning operation member of the cam lever to the mounted body.

According to the fifth aspect of the invention, since the first connector is temporarily locked to the mounted body when the first connector and the second connector are fitted to each other, it is easy to position the first connector and the second connector.

The sixth aspect of the invention provides a connector support mechanism according to the fifth aspect of the invention, wherein a distance between the turning operation member and the cam lever is set longer than a distance between a pivot portion of the cam lever and each position in the cam groove.

According to the sixth aspect of the invention, since a distance of an arm of a moment from a fulcrum to a point of force is set longer than a distance of an arm of a moment from the fulcrum to a point of application. Therefore, servo function can be obtained, both the connectors can reliably be fitted to each other even if a force for pushing the second connector is small, and the assembling operation is enhanced. The seventh aspect of the invention provides a connector support mechanism according to the first aspect of the invention, wherein the cam groove comprising: a boss introducing region formed on an end edge of the cam lever; a servo operation region formed continuously with the boss introducing region for forcibly moving the boss as the cam lever turns; and an idling operation region formed continuously with the servo operation region for allowing relative movement with the boss by returning motion of the mounted body when the mounted body is bent, and the idling operation region functioning as a terminal portion of the cam groove.

According to the seventh aspect of the invention, by setting a shape of the cam groove, the fitting state of both the connectors and a bending return of the mounted body can be absorbed, and a connector support mechanism in which the bending of the mounted body is taken into consideration can be realized by adding the idling operation region to the cam groove. Therefore, the connector support mechanism can be applied in accordance with various materials and characteristics of the mounted body having strength.

DETAILED DESCRIPTION OF THE PREFERRED EMBODIMENTS

Figure 1:
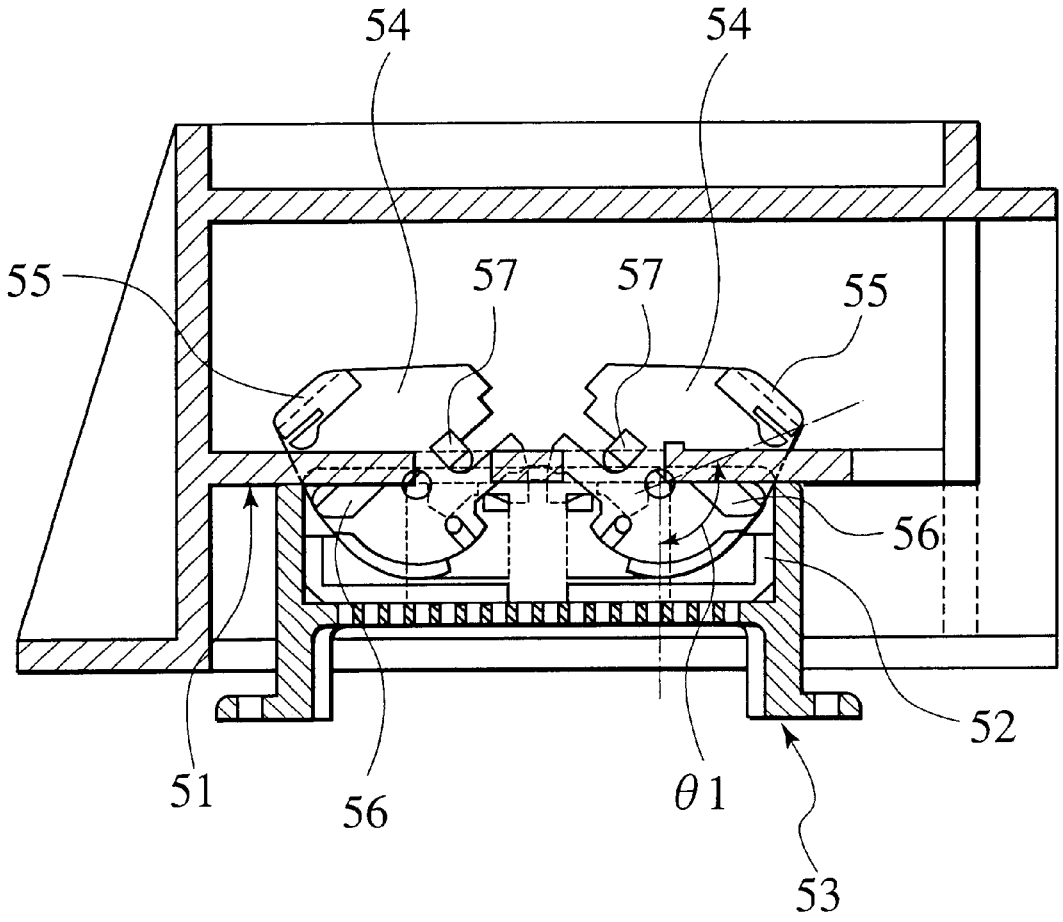
FIG.1 PRIOR ART
FIG. 1 is a perspective view showing a fitted state in a conventional connector support mechanism.
Figure 2:
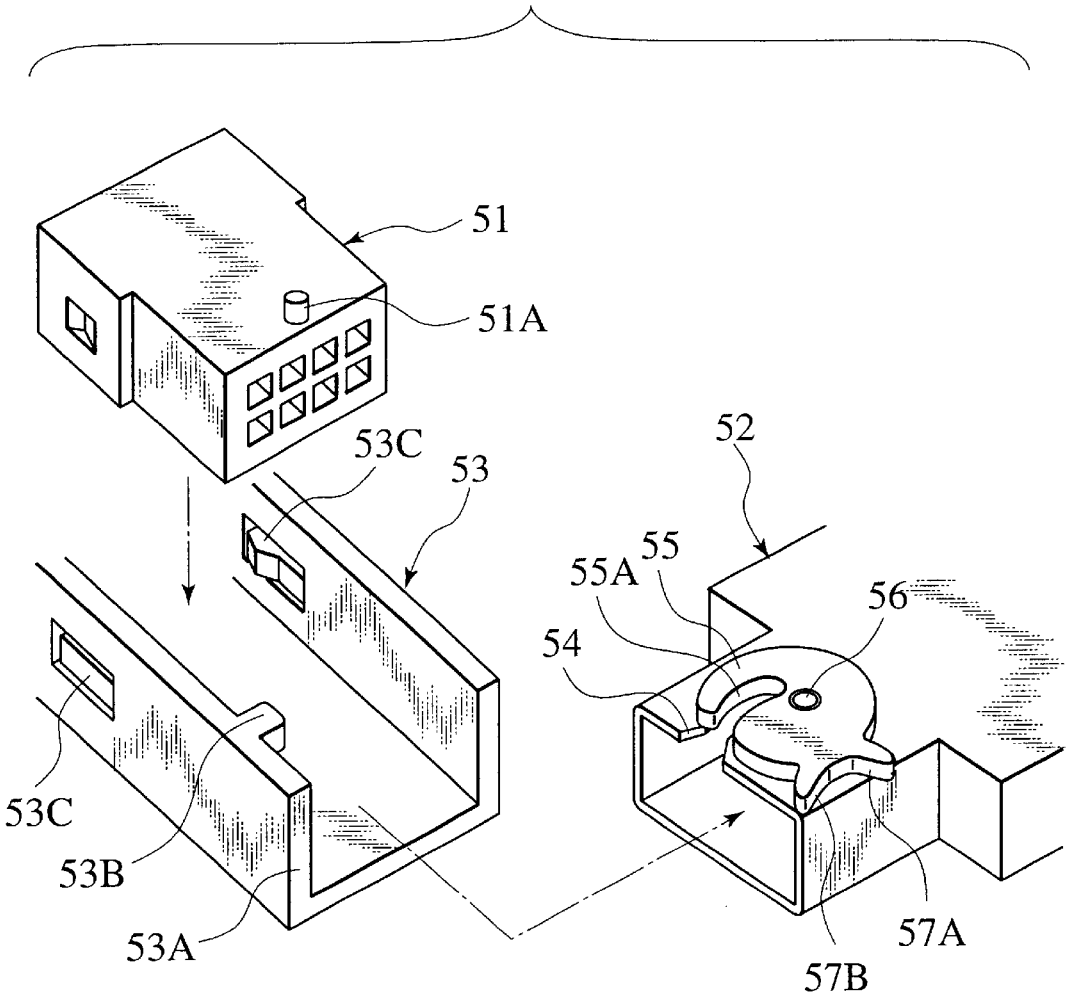
FIG.2 PRIOR ART
FIG. 2 is a perspective view showing another conventional connector support mechanism.
Figure 3:
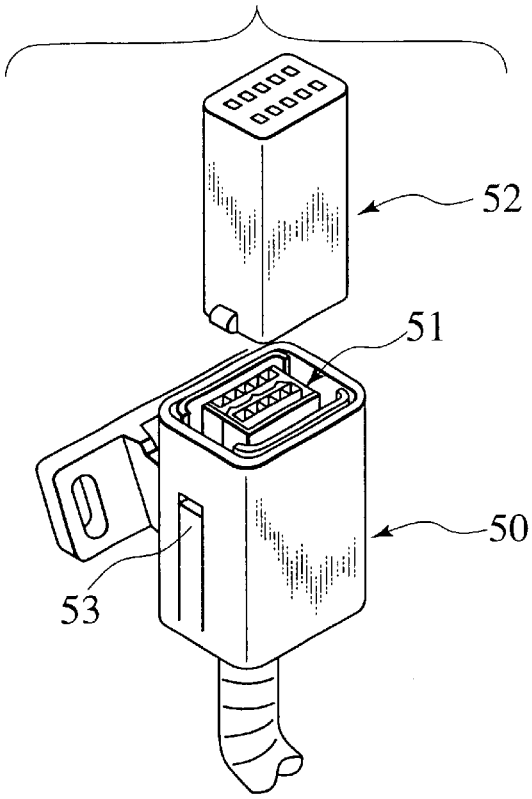
FIG.3 PRIOR ART
FIG. 3 is a perspective view showing another conventional connector support mechanism.
Figure 4:
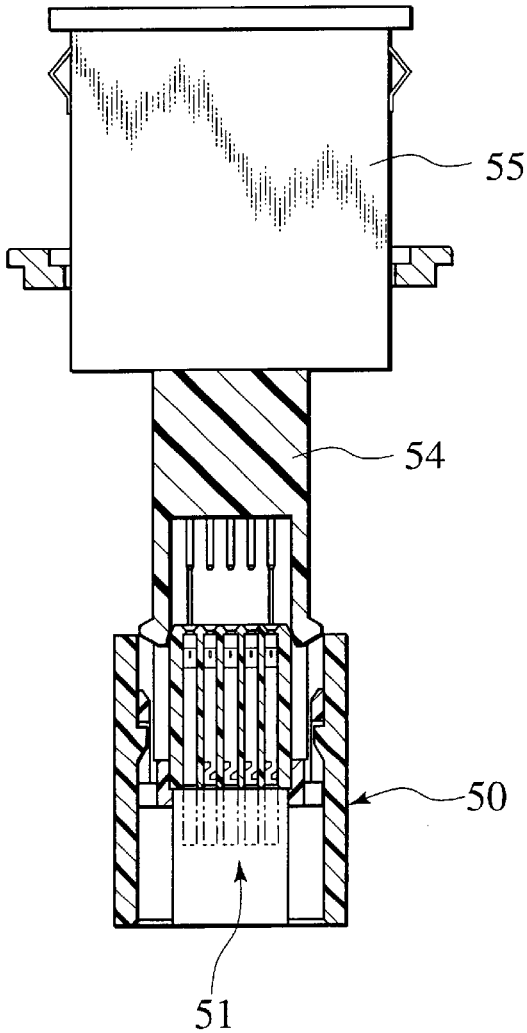
FIG.4 PRIOR ART
FIG. 4 is a sectional view of the conventional connector support mechanism shown in FIG. 3.

Details of a connector support mechanism according to the present invention will be explained based on embodiments shown in the drawings.

Figure 5:
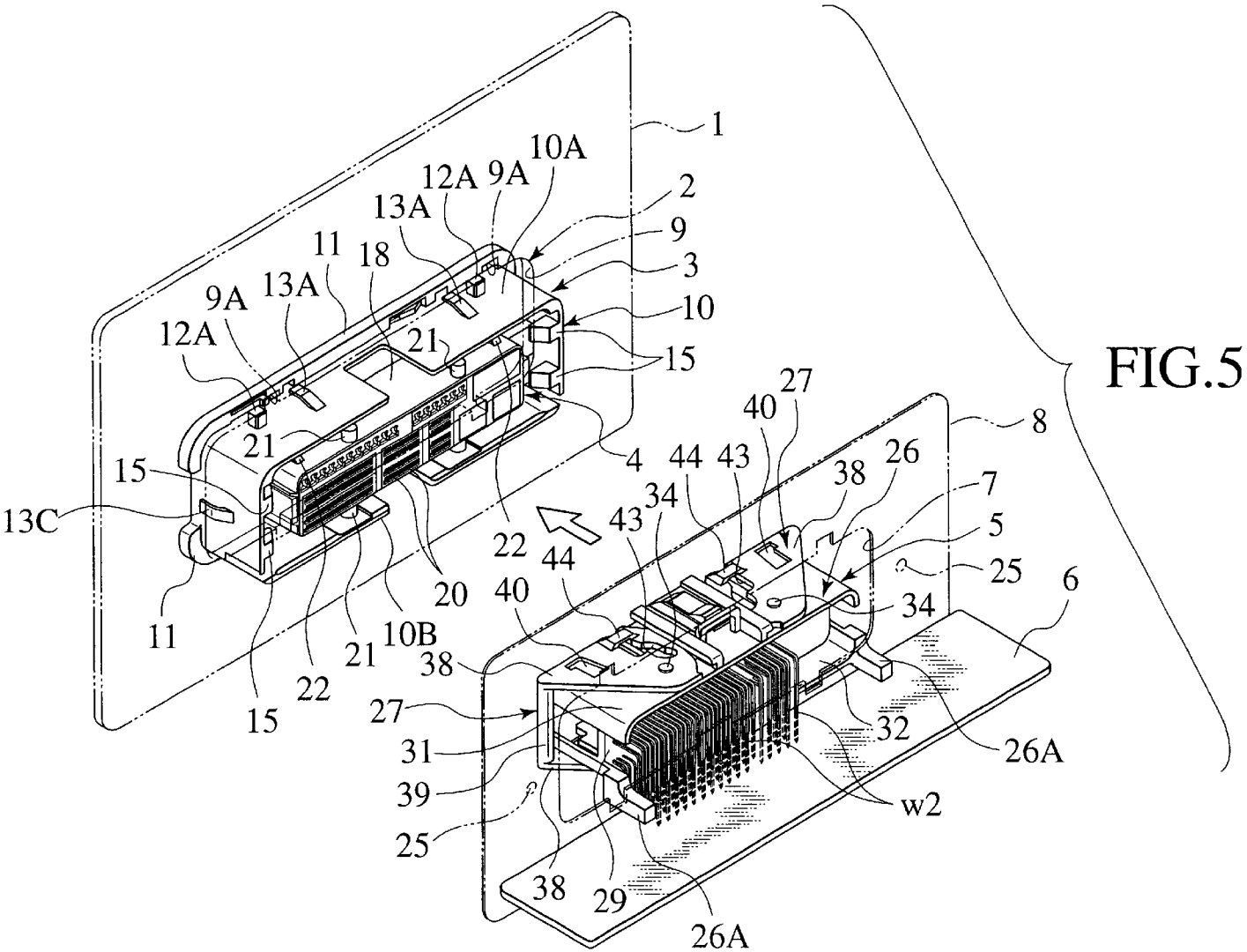
FIG. 5 is a perspective view showing an embodiment of a connector support mechanism according to the present invention.

As shown in FIG. 5, a connector support mechanism of the present embodiment comprises a member 2 mounted (mounted member, hereinafter) of an instrument panel 1 provided on a stay member of an automobile for example, a bracket 3 mounted to the mounted member 2, a female connector 4 as a first connector locked to the bracket 3, a male connector 5 as a second connector connected to the female connector 4, a board 6 on the side of equipment to which the male connector 5 is fixed, and an escutcheon 8 standing on an end edge of the board 6 and formed with a connector passing-through opening 7 through which the male connector 5 protrudes outward from the equipment.

Figure 6:
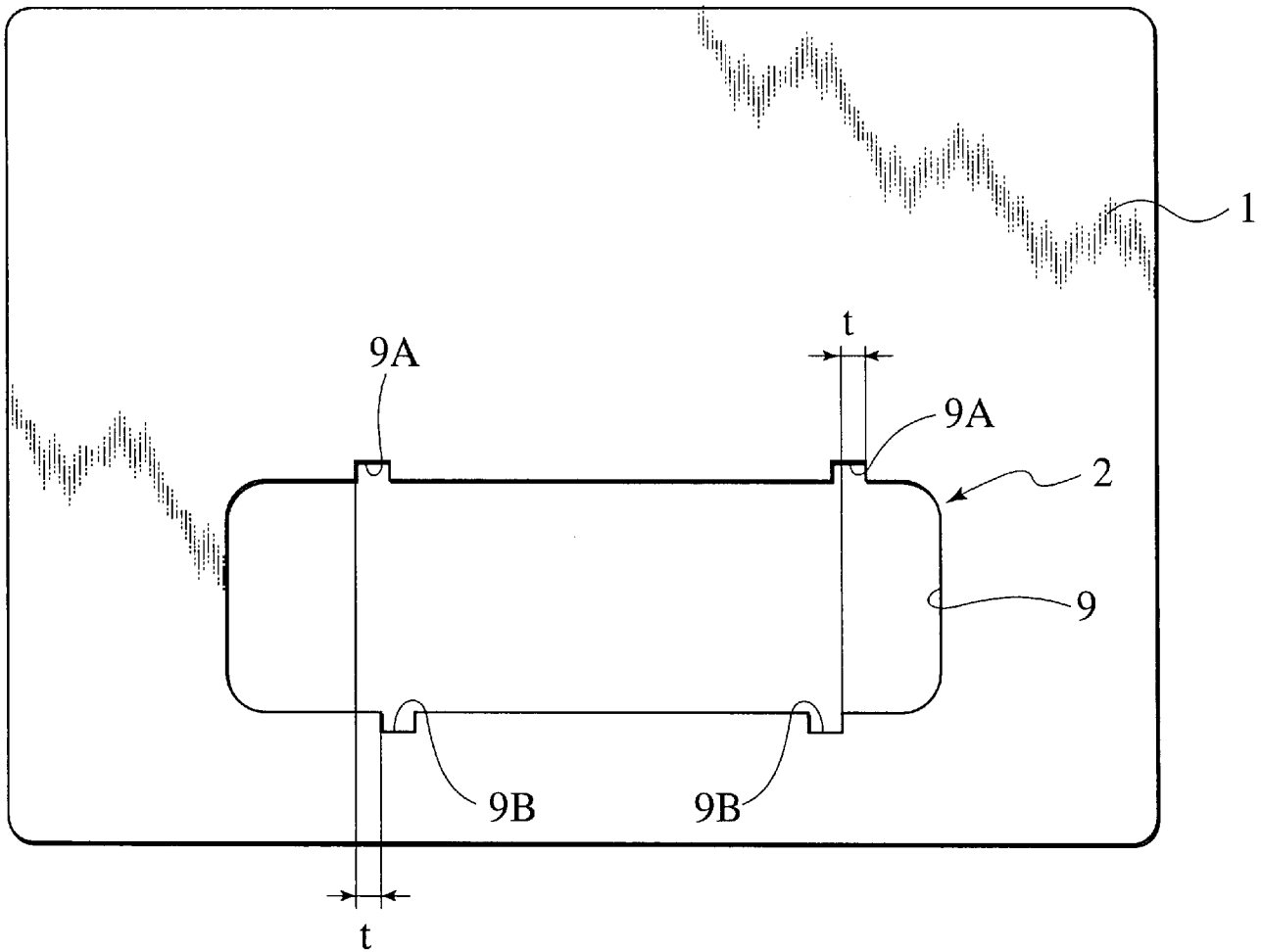
FIG. 6 is a front view showing a bracket locking opening of an instrument panel.

First, a structure of the mounted member 2 of the instrument panel 1 will be explained using FIG. 6. The mounted member 2 is provided on a bottom surface of a recess formed in the instrument panel 1. The mounted member 2 is formed at its instrument panel 1 with a bracket locking opening 9. The bracket locking opening 9 is formed at its upper edge with a pair of notches 9A and 9A. The bracket locking opening 9 is also formed at its lower edge with a pair of notches 9B and 9B. As shown in FIG. 6, the lower notches 9B and 9B are located at inner sides than the upper notches 9A and 9A by a distance t, whereby defining the mounting direction of the bracket 3 (which will be described later) and positioning the bracket 3 properly.

Next, a structure of the bracket 3 will be explained using FIGS. 5 and 7 to 11. The bracket 3 comprises a substantially cylindrical connector temporarily locking cylinder 10, and flange portions 11 formed such as to protrude sideways respectively along an upper edge and a lower edge of a base end of the connector temporarily locking cylinder 10. As shown in FIG. 5, the flange portions 11 respectively formed on the upper and lower edges are formed such as to wraparound opposite sides of the base end (rear end) of the bracket 3.

The connector temporarily locking cylinder 10 has a sectional shape slightly smaller than the bracket locking opening 9 so that the connector temporarily locking cylinder 10 can be inserted into the substantially rectangular bracket locking opening 9 formed in the mounted member 2. Each of the flange portions 11 is set such that when the connector temporarily locking cylinder 10 is inserted into the bracket locking opening 9, the flange portion 11 abuts a peripheral edge of the bracket locking opening 9 and can not be inserted into the bracket locking opening 9. The flange portion 11 is formed such that it protrudes sideway from the base end of the connector temporarily locking cylinder 10 by a predetermined distance.

Figure 7:
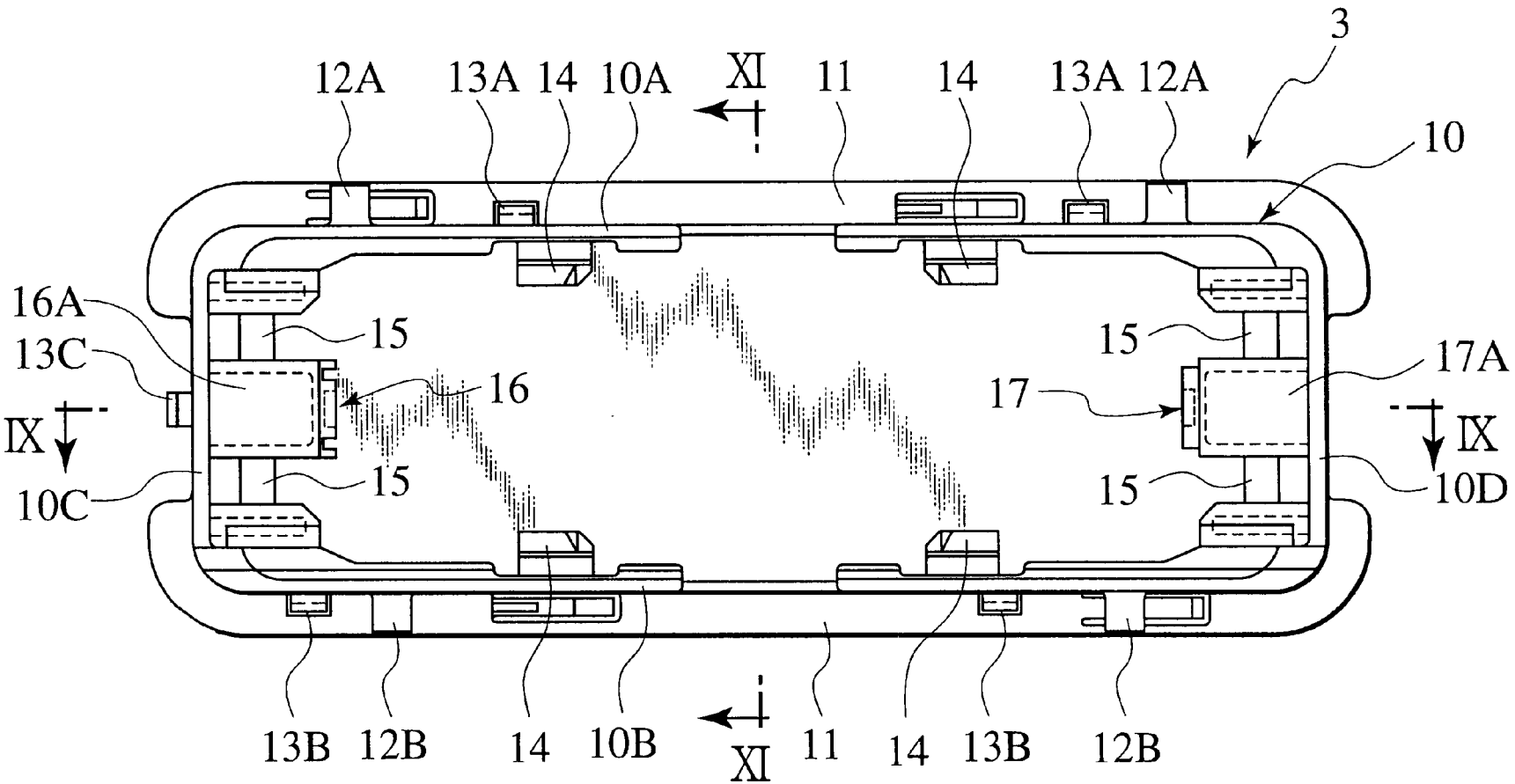
FIG. 7 is a plan view of the bracket.
Figure 8:
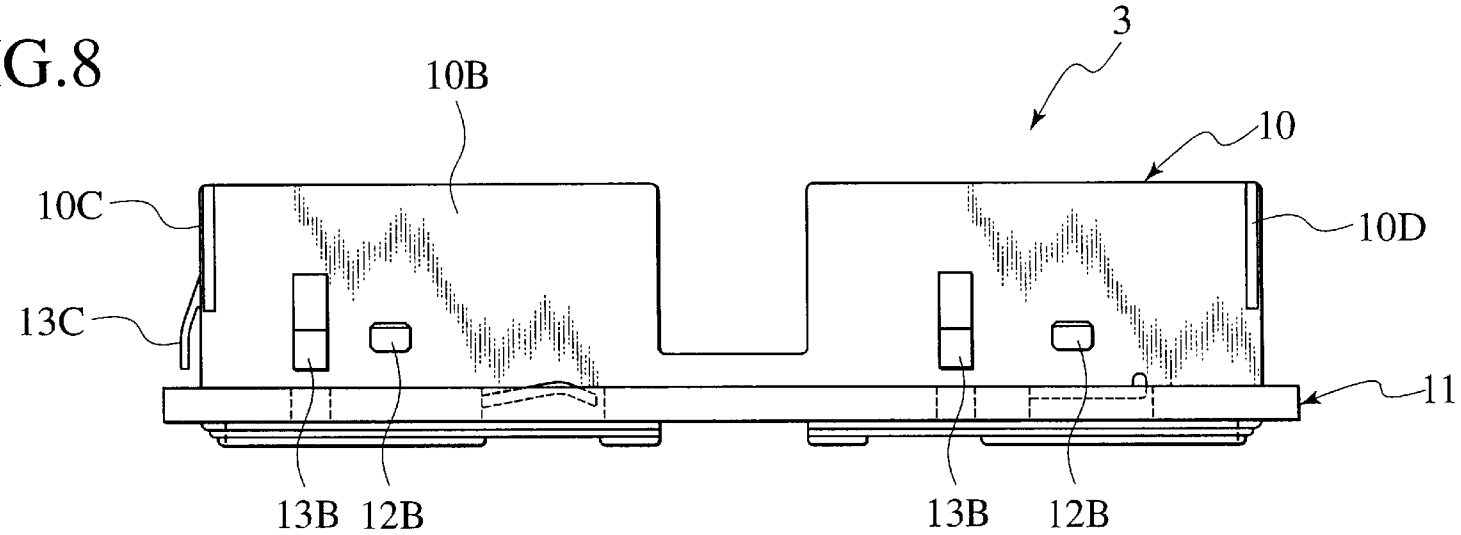
FIG. 8 is a plan view of the bracket.

As shown in FIGS. 5 and 7, panel holding protrusions 12A and 12A protrude sideways from outer side surfaces of one (upper) of side walls 10A of the connector temporarily locking cylinder 10 in the vicinity of the base end. A distance between these panel holding protrusions 12A and 12A is set to be the same as a distance between the notches 9A and 9A formed on the upper edge of the bracket locking opening 9. The panel holding protrusion 12A has such a size that the panel holding protrusion 12A can be inserted through the notch 9A. As shown in FIGS. 7 and 8, panel holding protrusions 12B and 12B protrude sideways from outer side surfaces of the other (lower) side wall 10B of the connector temporarily locking cylinder 10 in the vicinity of the base end. A distance between the panel holding protrusions 12B and 12B is set to be the same as a distance between the notches 9B and 9B formed in the lower edge of the bracket locking opening 9. The panel holding protrusion 12B has such a size that the panel holding protrusion 12B can be inserted through the notch 9B.

These panel holding protrusions 12A, 12A, 12B and 12B have positional relation corresponding to the notches 9A, 9A, 9B and 9B so that the protrusions can simultaneously pass through the notches 9A, 9A, 9B and 9B formed in the bracket locking opening 9. That is, the panel holding protrusions 12B and 12B are located at inner sides in widthwise direction than the panel holding protrusions 12A and 12A by the distance t.

The one side wall 10A is formed with resilient locking pawls 13A and 13A rising diagonally toward the base end at inner sides of the panel holding protrusions 12A and 12A. The other side wall 10B is formed with resilient locking pawls 13B and 13B rising diagonally toward the base end at inner sides of the panel holding protrusions 12B and 12B. As shown in FIGS. 5, 7 and 8, opposite side walls 10C and 10D are sandwiched between side walls 10A and 10B in the connector temporarily locking cylinder 10. The side wall 10C is also formed with the same locking pawl 13C such as to rise diagonally toward the base end.

A pair of temporarily locking arms 14 and 14 are provided on an inner surface of each of the side walls 10A and 10B of the connector temporarily locking cylinder 10. These temporary locking arms 14 and 14 are formed such as to rise diagonally inward from the base end of the connector temporarily locking cylinder 10 toward a tip end thereof. These temporarily locking arms 14 and 14 temporarily lock the female connector 4 which will be described later.

Figure 9:
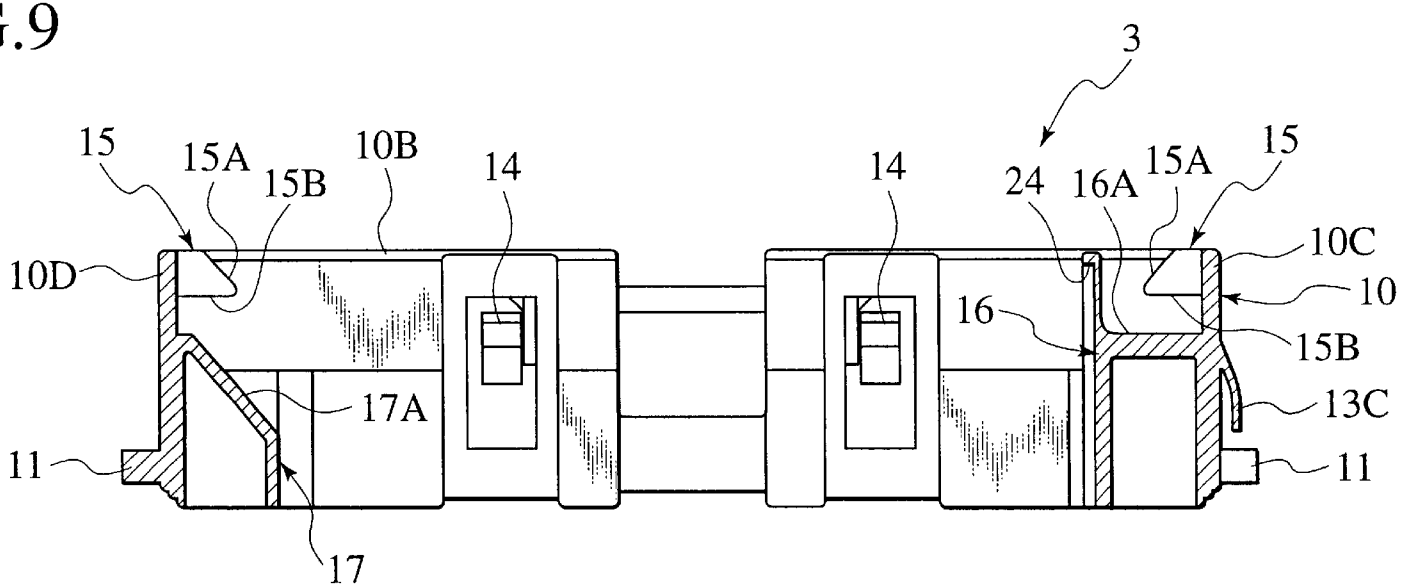
FIG. 9 is a sectional view taken along a 9—9 line in FIG. 7.
Figure 10:
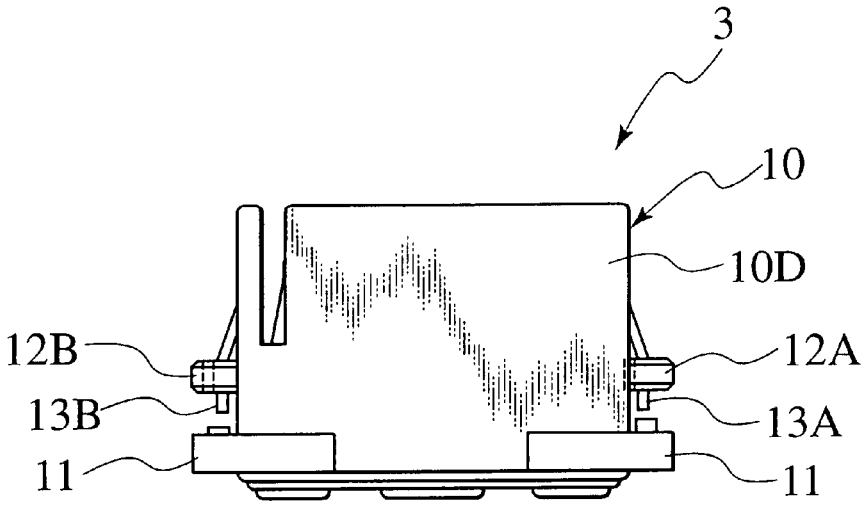
FIG. 10 is a side view of the bracket.
Figure 11:
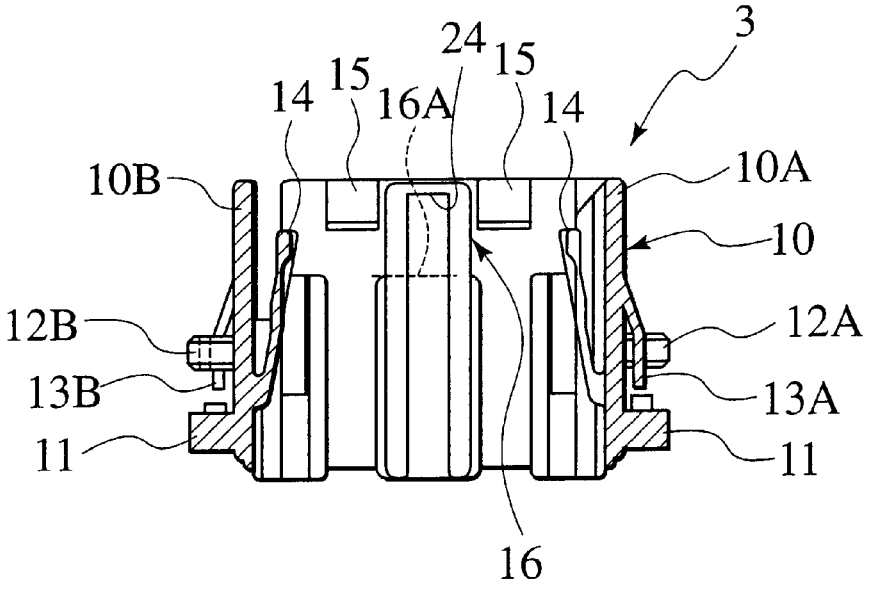
FIG. 11 is a sectional view taken along a 11—11 line in FIG. 7.

As shown in FIGS. 7 and 9, a pair of lever-separating force applying protrusions 15 and 15 protrude inward from tip ends of inner side surfaces of the opposite side walls 10C and 10D of the connector temporarily locking cylinder 10. The lever-separating force applying protrusions 15 and 15 formed on the side walls 10C and 10D are disposed at a predetermined distance from each other. As shown in FIG. 9, a lever capturing protrusion 16 for capturing the cam lever (which will be described later) protrudes inward from a rear portion (closer to the base end) at an intermediate position between the pair of lever-separating force applying protrusions 15 and 15 of the side wall 10C. Further, a guide protrusion 17 having a guide surface 17A for guiding a female connector housing (which will be described later) protrudes inward from a rear portion at an intermediate position between the pair of lever-separating force applying protrusions 15 and 15 of the side wall 10D. The female connector housing is inserted into a space between these lever capturing protrusion 16 and the guide protrusion 17.

The lever-separating force applying protrusions 15 and 15 and the lever capturing protrusion 16 are set to be located substantially sideways in a region where a lever mounting shaft 34 moves between a fitting starting state (state immediately before the fitting is completed) between the female connector 4 and the male connector 5 and a fitting completion state. Therefore, it is possible to efficiently convert a force for pushing the male connector 5 into a fitting direction into a force for turning a cam lever 27. As shown in FIG. 9, each of the lever-separating force applying protrusions 15 and 15 comprises a guide slant 15A for guiding a turning operation member 39 (which will be described later) of the cam lever 27, and a separation force applying surface 15B which the turning operation member 39 abuts at the time of separation operation. The separation force applying surface 15B is formed such that it intersects with inner surfaces of the side walls 10C and 10D substantially at right angles.

Figure 12:
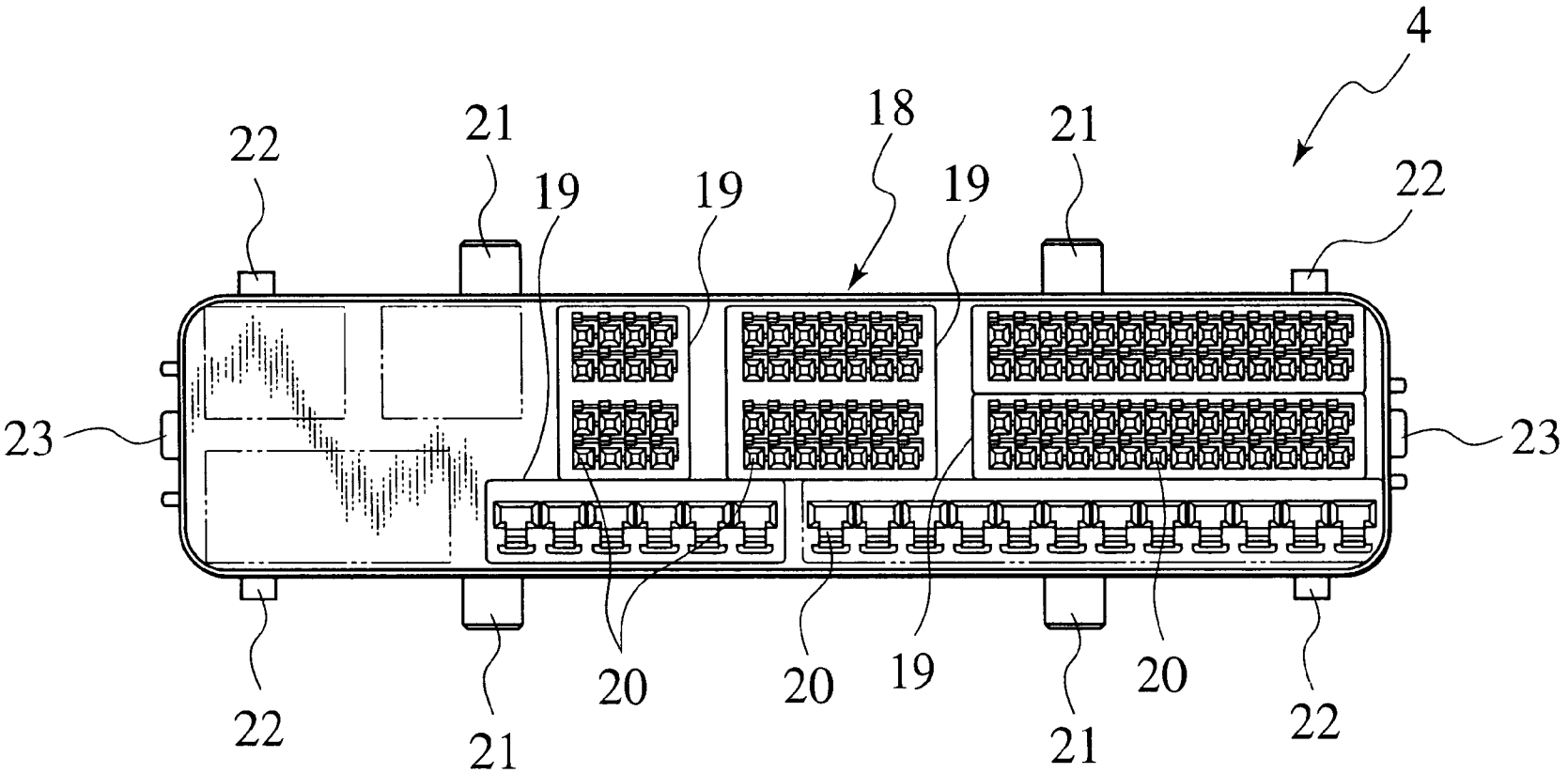
FIG. 12 is a plan view of a female connector housing.
Figure 13:
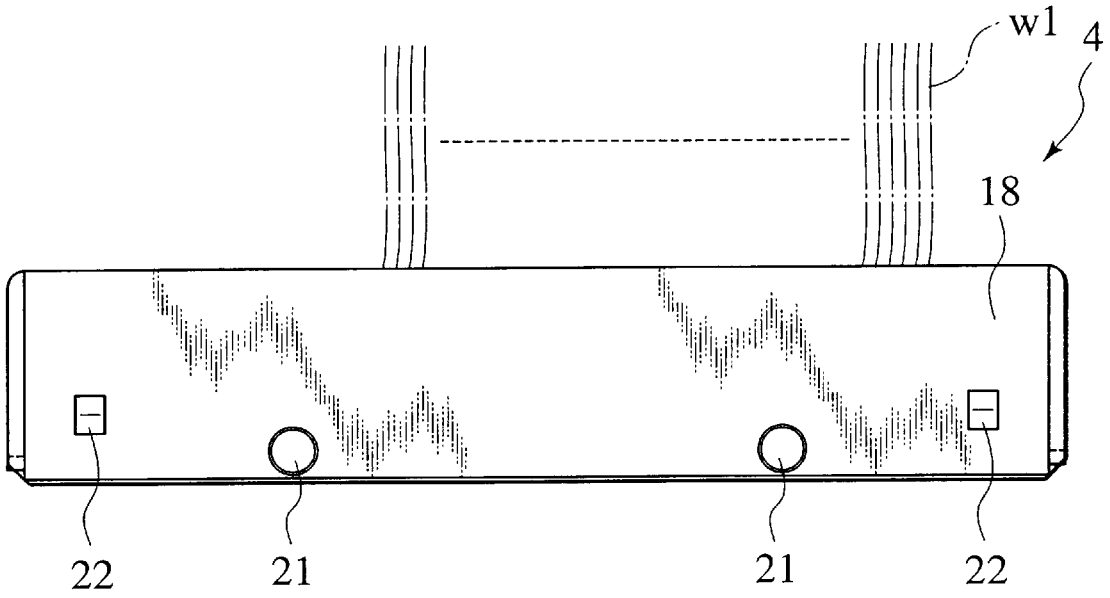
FIG. 13 is a front view of the female connector housing.
Figure 14:
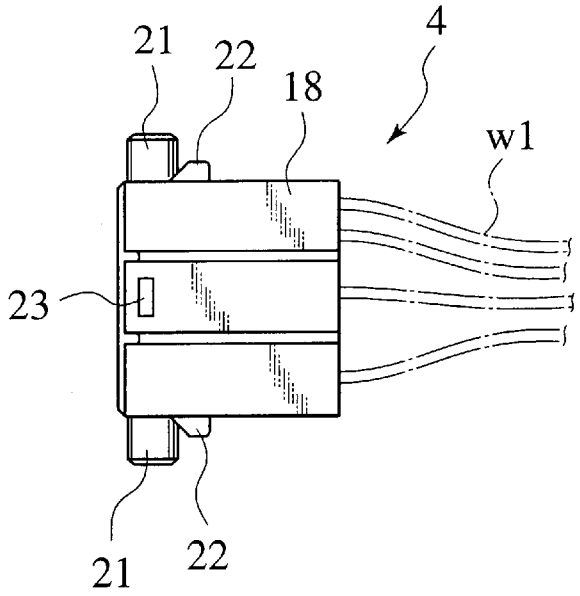
FIG. 14 is a side view of the female connector housing.

Next, a structure of the female connector 4 will be explained using FIGS. 5 and 12 to 14. The female connector 4 comprises a female connector housing 18, accommodation blocks 19 for accommodating a plurality of terminal accommodating chambers formed in the female connector housing 18, and a plurality of female connector terminals 20 respectively accommodated in terminal accommodating chambers of the accommodation blocks 19. As shown in FIG. 12, connection openings of the female connector terminals 20 are disposed and fixed such that the connection openings are located in a front end surface of the female connector housing 18. Wires W1 are connected to rear ends of the female connector terminals 20. As shown in FIGS. 13 and 14, these wires w1 are pulled out from a rear end of the female connector housing 18.

A pair of bosses 21 and 21 as protrusions guided protrude from a front end of an upper surface of the female connector housing 18 at a predetermined distance from each other. The bosses 21 and 21 are engaged with guide grooves of the cam lever (which will be described later). Similarly, another pair of bosses 21 and 21 protrude from a front end of a lower surface of the female connector housing 18. These bosses 21 and 21 are disposed at positions corresponding to the temporarily locking arms 14 and 14 formed on the inner surface of the bracket 3 when the female connector 4 is inserted into the bracket 3. Spacers 22 protrude on axially opposite sides of the upper and lower surfaces of the female connector housing 18 for separating the female connector housing 18 from the inner wall surface of the bracket 3 through a predetermined distance. As shown in FIGS. 12 and 14, stoppers 23 protrude from tip ends of opposite side surfaces of the female connector housing 18 for defining an insertion terminal point of the female connector 4 when the female connector 4 is inserted into the bracket 3. Correspondingly, stopper receivers 24 are formed on the bracket 3 for abutting the stoppers 23 to define an insertion terminal point of the female connector 4.

A procedure for mounting the bracket 3 to the mounted member 2, and a procedure for temporarily locking the female connector 4 to the bracket 3 will be explained.

The bracket 3 inserts the connector temporarily locking cylinder 10 into the bracket locking opening 9 from a back side of the instrument panel 1. At that time, the four panel holding protrusions 12A, 12A, 12B and 12B are simultaneously positioned with respect to the four notches 9A, 9A, 9B and 9B formed in the opening peripheries of the bracket locking opening 9. By inserting the connector temporarily locking cylinder 10 into the bracket locking opening 9 in this manner, the flange portion 11 of the bracket 3 abuts the opening edge of the bracket locking opening 9. Thereafter, by moving the bracket 3 laterally along a surface of the instrument panel 1, the panel holding protrusions 12B and 12B are deviated in position with respect to the notches 9A and 9B, and it is possible to prevent the connector temporarily locking cylinder 10 from returning rearward from the instrument panel 1 and being pulled out. At that time, the instrument panel 1 of the opening edge of the bracket locking opening 9 is sandwiched between the flange portion 11 and the panel holding protrusions 12A and 12B, and the locking pawls 13A, 13B and 13C enter a gap between the instrument panel 1 and the female connector housing 18 and resiliently abut the opening inner wall of the instrument panel 1. As a result, the bracket 3 is held and fixed by the mounted member 2 of the instrument panel 1.

To temporarily lock the 4 to the bracket 3, a tip end of the female connector 4 is inserted from an opening of the base end of the bracket 3. Further, the stoppers 23 of the female connector housing 18 are fitted into the stopper receivers 24 on the side of the bracket 3 until the stoppers 23 abut the stopper receivers 24. With this movement, the bosses 21 and 21 of the female connector housing 18 ride over the temporarily locking arms 14 and 14 and tip ends of the temporarily locking arms 14 and 14 abut the side surfaces of the bosses 21 and 21, and the female connector 4 is prevented from returning and temporarily locked. The operation for temporarily locking the female connector 4 to the bracket 3 may be carried out before or after the bracket 3 is mounted to the instrument panel 1.

Figure 15:
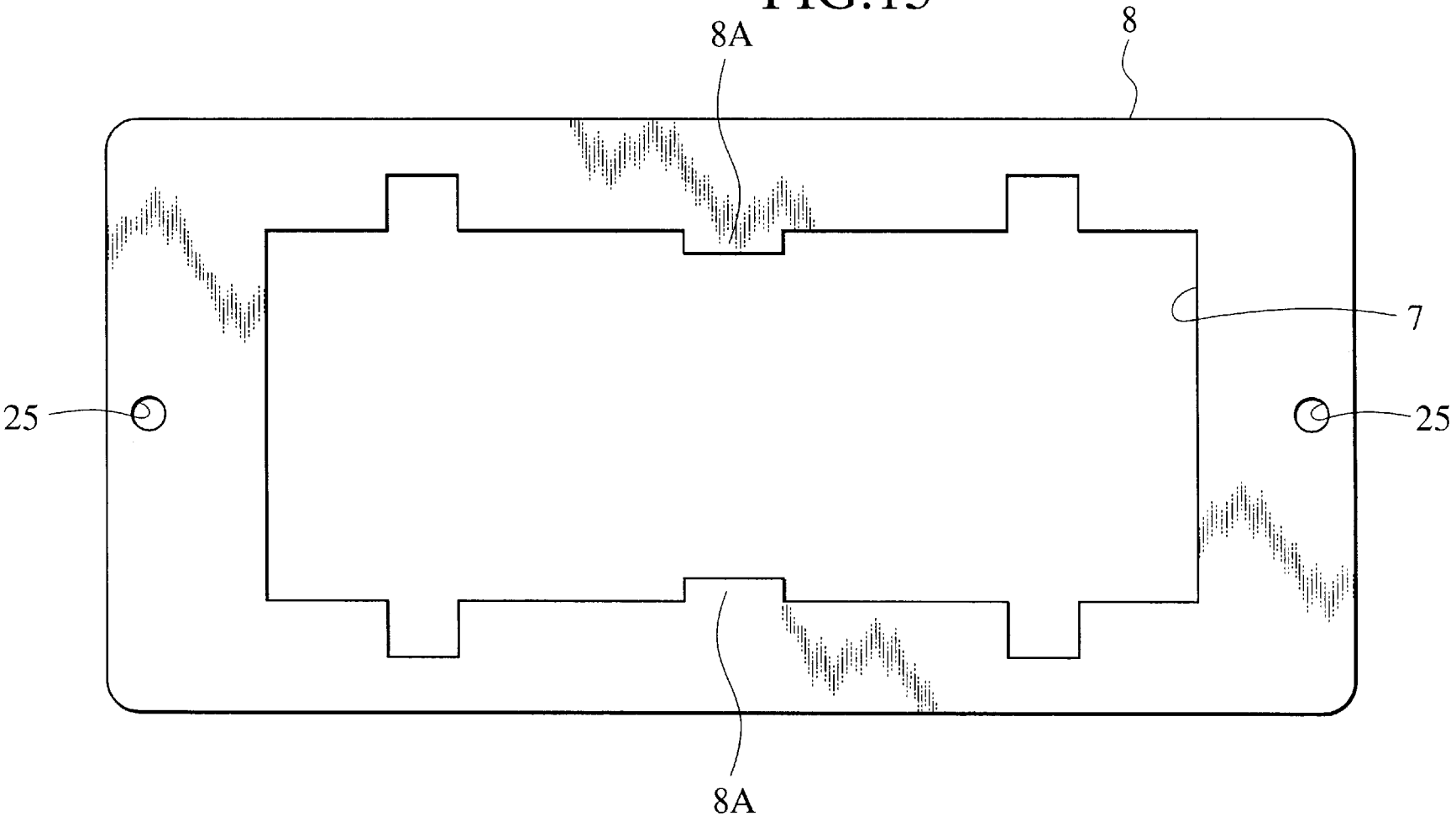
FIG. 15 is a front view of an escutcheon.

A structure of the male connector 5 will be explained using FIGS. 5 and 15 to 23. As shown in FIG. 5, mounted members 26A are fixed to the board 6 on the side of equipment. An escutcheon 8 stands on a rear end edge of the board 6 such as to form a right angle with respect to the board 6. As shown in FIG. 15, the escutcheon 8 is formed with the connector passing-through opening 7 for allowing the male connector 5 to protrude outward. Screw insertion openings 25 and 25 for screwing the instrument panel 1 are formed in opposite sides of the connector passing-through opening 7 formed in the escutcheon 8. Hanging projections 8A hung on the male connector housing 26 (which will be described later) are formed in central portion of upper end lower side edges of the connector passing-through opening 7.

As shown in FIG. 5, the male connector 5 comprises the male connector housing 26, and a pair of cam levers 27 and 27 turnably supported by the male connector housing 26.

Figure 16:
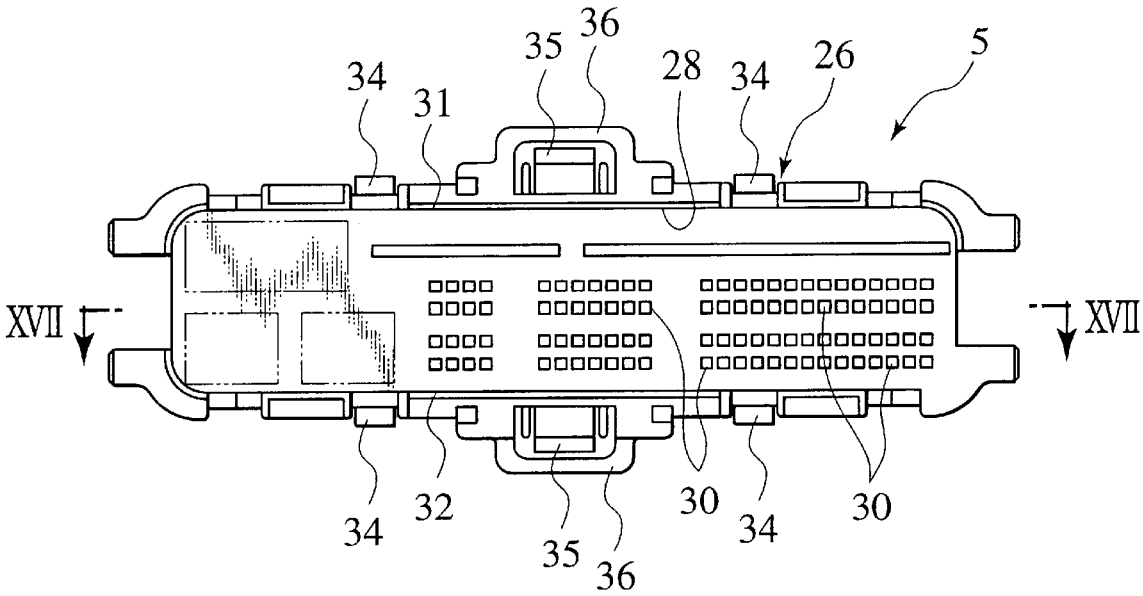
FIG. 16 is a plan view of a male connector housing.
Figure 17:
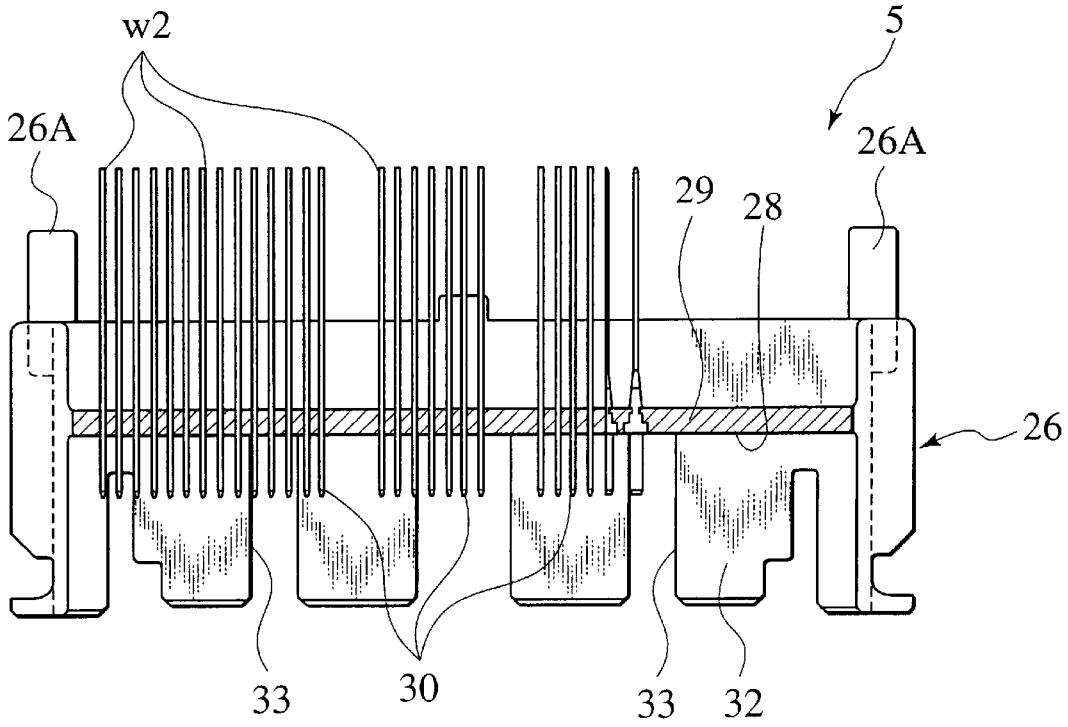
FIG. 17 is a sectional view taken along a 17—17 line in FIG. 16.
Figure 21:
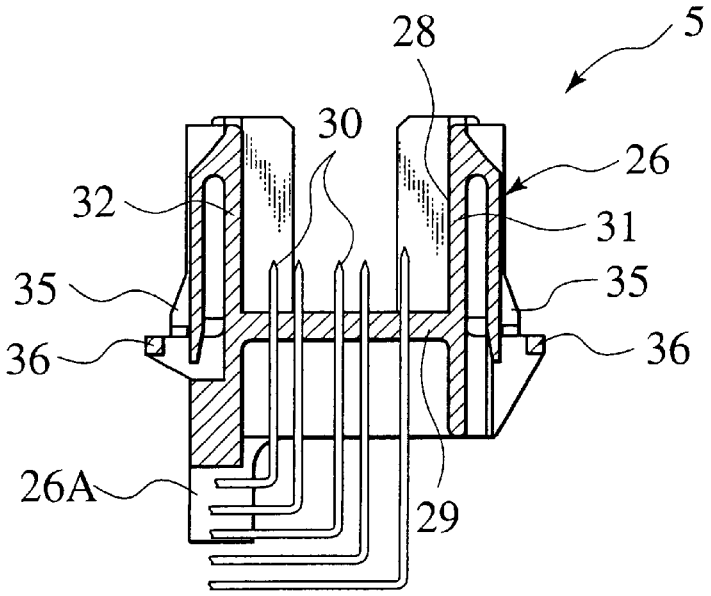
FIG. 21 is a sectional view taken along a 21—21 line in FIG. 19.

As shown in FIGS. 16, 17 and 21, the male connector housing 26 is provided at its front end side with a fitting recess 28 in which the female connector housing 18 is fitted. A plurality of male connector terminals 30 are disposed on a bottom plate 29 of the fitting recess 28 such as to protrude toward the tip end of the male connector 5. These male connector terminals 30 pass through the bottom plate 29, and wires w2 are connected to the rear ends of the male connector terminals 30. The wires w2 are connected to wires (not shown) on the side of the board 6, and connected to various circuits or electronic components.

The male connector housing 26 is provided at upper and lower edges of the bottom plate 29 with an upper side wall 31 and a lower side wall 32 extending longitudinal direction (fitting direction) of the male connector 5. The upper side wall 31 and the lower side wall 32 are substantially in parallel to each other. The mounted members 26A extend rearward from opposite sides of a rear end of the lower side wall 32.

Figure 18:
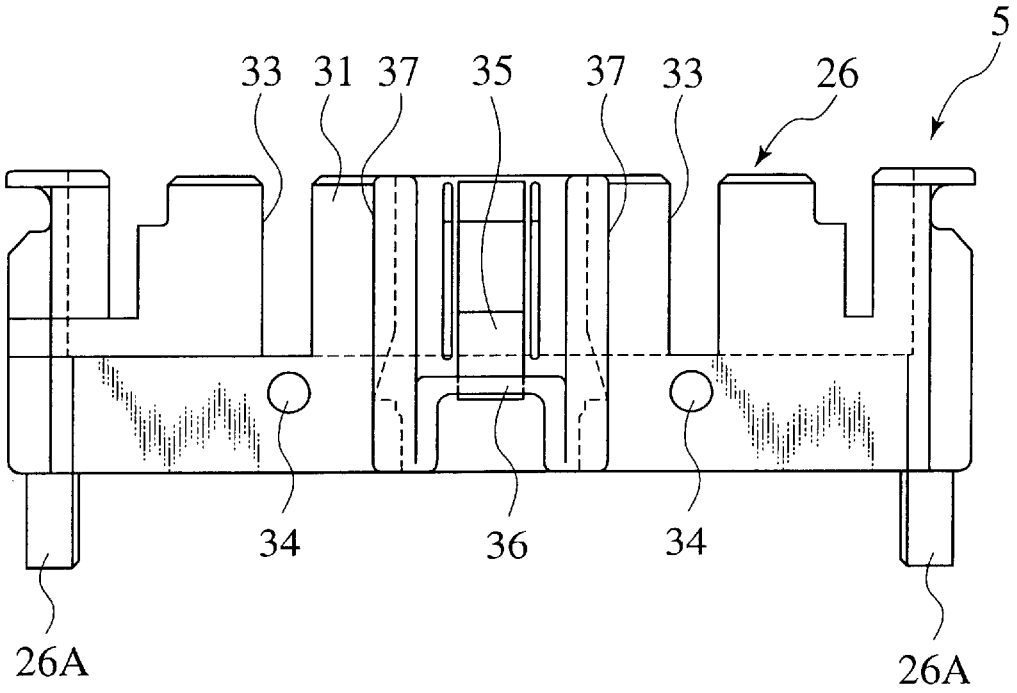
FIG. 18 is a front view of a male connector housing.
Figure 19:
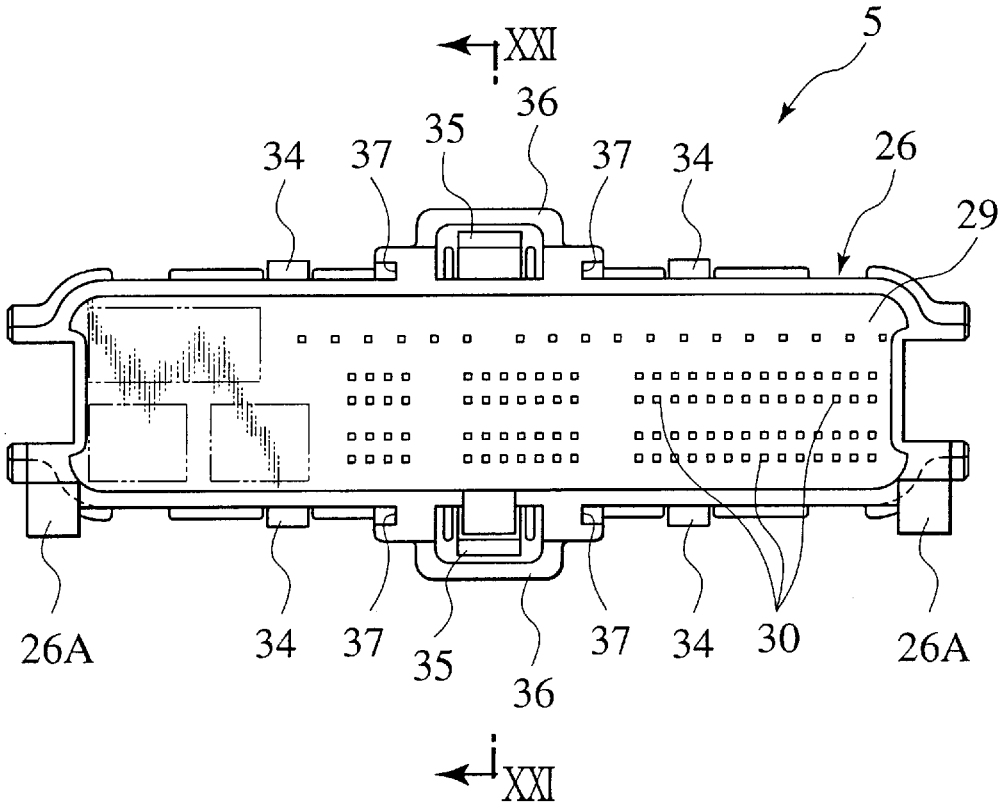
FIG. 19 is a rear view of the male connector housing.
Figure 20:
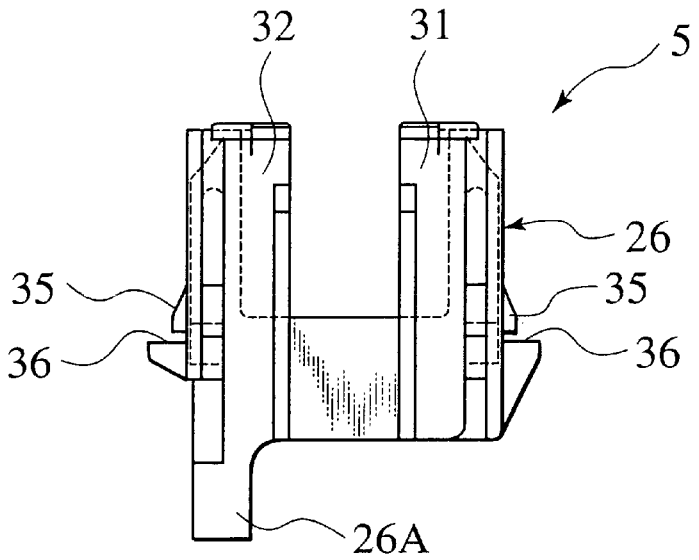
FIG. 20 is a side view of the male connector housing.

As shown in FIGS. 17 and 18, the upper side wall 31 and the lower side wall 32 are respectively formed with a pair of boss-guiding slits 33 and 33 for guiding the bosses 21 of the female connector 4 when the male connector 5 is fitted to the female connector 4. Lever mounting shafts 34 protrude from rear portions (rearward in the fitting direction) of the boss-guiding slits 33.

A resilient and plastic panel hanging piece 35 rising diagonally from the front end toward the rear end, and a panel hooking portion 36 standing from a rear end of the panel hanging piece 35 are formed between the pair of boss-guiding slits 33 and 33.

The hanging projections 8A of the escutcheon 8 are disposed between the panel hanging piece 35 and the panel hooking portion 36, thereby holding the male connector housing 26 by the escutcheon 8.

Bank-like turning-motion restricting portions 37 for defining turning-motion terminal point of the cam lever 27 are formed on opposite sides of the panel hanging piece 35 and the 36.

Using FIGS. 22 and 23, a structure of the cam lever 27 mounted to the male connector housing 26 will be explained.

The cam lever 27 comprises substantially triangular two lever plates 38 which are in parallel to each other, and a rod-like turning operation portion 39 for integrally connecting apexes of these lever plates 38.

Figure 23:
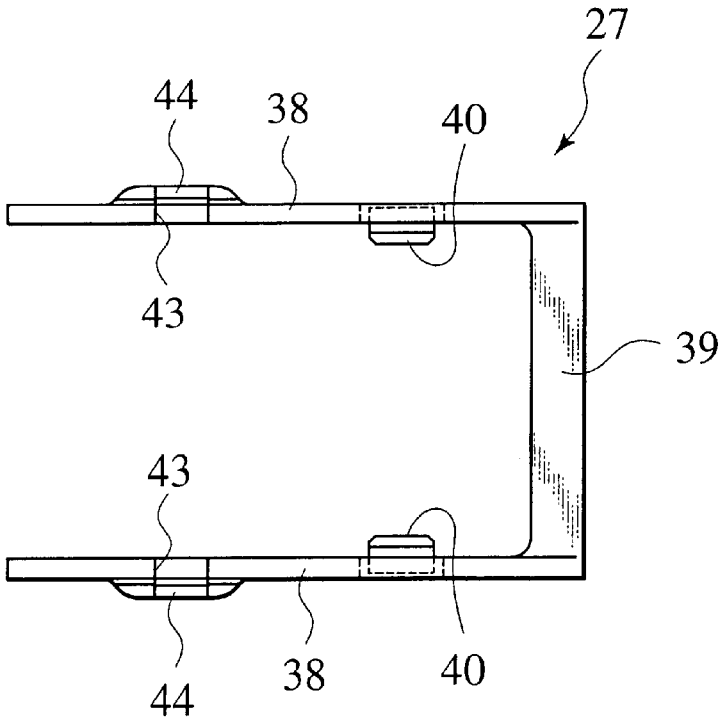
FIG. 23 is a side view of the cam lever.

As shown in FIG. 23, each of the lever plates 38 is formed at its portion near the turning operation portion 39 with a lever temporarily locking piece 40 rising slightly diagonally toward the opposed other lever plate 38. The lever temporarily locking piece 40 is formed for temporarily locking the cam lever 27 in an initial state position with respect to the male connector housing 26.

In a predetermined portion of the lever plate 38 opposite from the turning operation portion 39 with respect to a central portion of the lever plate 38, a pivot hole 41 in which the boss 21 protruding from the male connector housing 26 is mounted is formed.

A cam groove 43 for guiding the boss 21 in accordance with turning motion of the lever plate 38 is formed on a side edge 42 of the pivot hole 41 in the lever plate 38. A reinforcing plate 44 is formed across an entrance portion located at the side edge 42 of the cam groove 43. This reinforcing plate 44 is formed astride the cam groove 43 so that the reinforcing plate 44 does not interfere with the boss 21 inserted into the cam groove 43.

Figure 22:
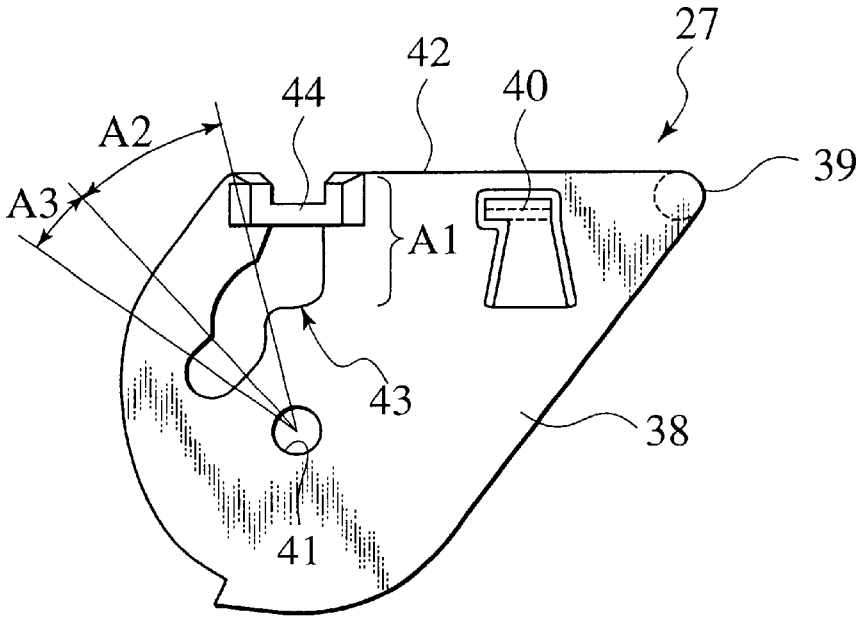
FIG. 22 is a plan view of a cam lever mounted to a male connector.

As shown in FIG. 22, the cam groove 43 comprises a boss introducing region A1 substantially straightly formed from the side edge 42 toward the pivot hole 41, a servo operation region A2 for forcibly moving the boss 21 guided to a deepest portion of the boss introducing region A1 to a position near the pivot hole 41 together with the turning motion of the lever plate 38, and an idling operation region A3.

The servo operation region A2 is a groove portion bent such as to gradually approach a center of the pivot hole 41. The idling operation region A3 is a groove portion formed along a circumference of a circle formed around the pivot hole 41. A length of the groove of the idling operation region A3 will be described later, but is set in accordance with a bending size of the mounted member 2 of the instrument panel 1.

Figure 24:
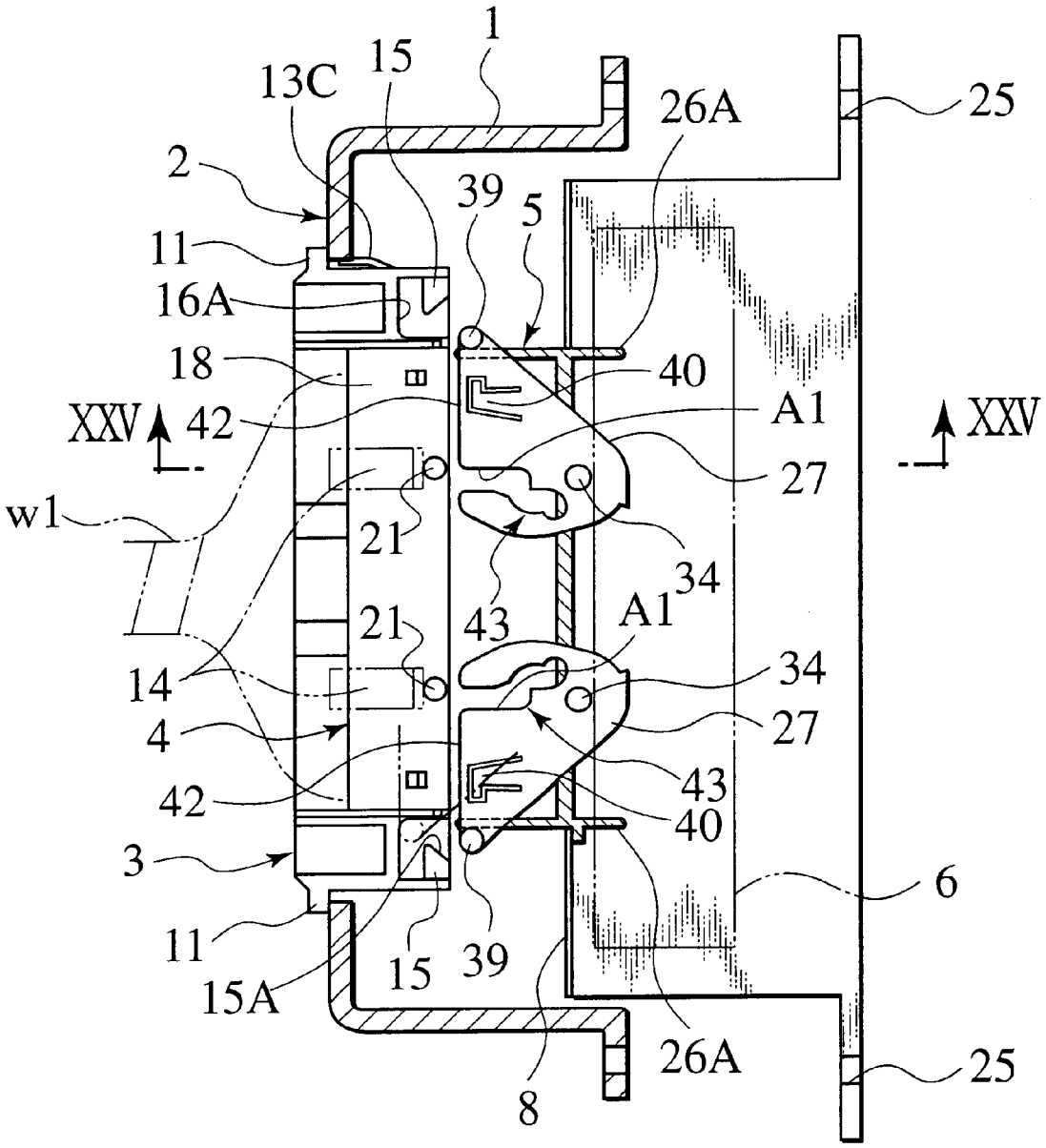
FIG. 24 is a partial sectional view showing a state immediately before the male connector is fitted to the female connector.

The cam lever 27 having such a structure is turnably pivoted around the lever mounting shafts 34 and 34 protruding from the upper side wall 31 and the lower side wall 32 of the male connector housing 26. When the cam levers 27 and 27 are in their initial state positions, as shown in FIGS. 5 and 24, the side edge 42 of the lever plate 38 is set such that the side edge 42 is substantially in parallel to a front end edge of the male connector housing 26. When the female connector 4 and the male connector 5 are fitted to each other, the cam levers 27 and 27 are turned in a direction in which the turning operation portion 39 moves toward the rear end of the male connector housing 26. That is, both the cam levers 27 and 27 are set such that they are turned in the directions opposite from each other.

An assembling operation method, effect and operation of the female connector 4 and the male connector 5 in the connector support mechanism of the present embodiment will be explained using FIGS. 24 to 34.

Figure 25:
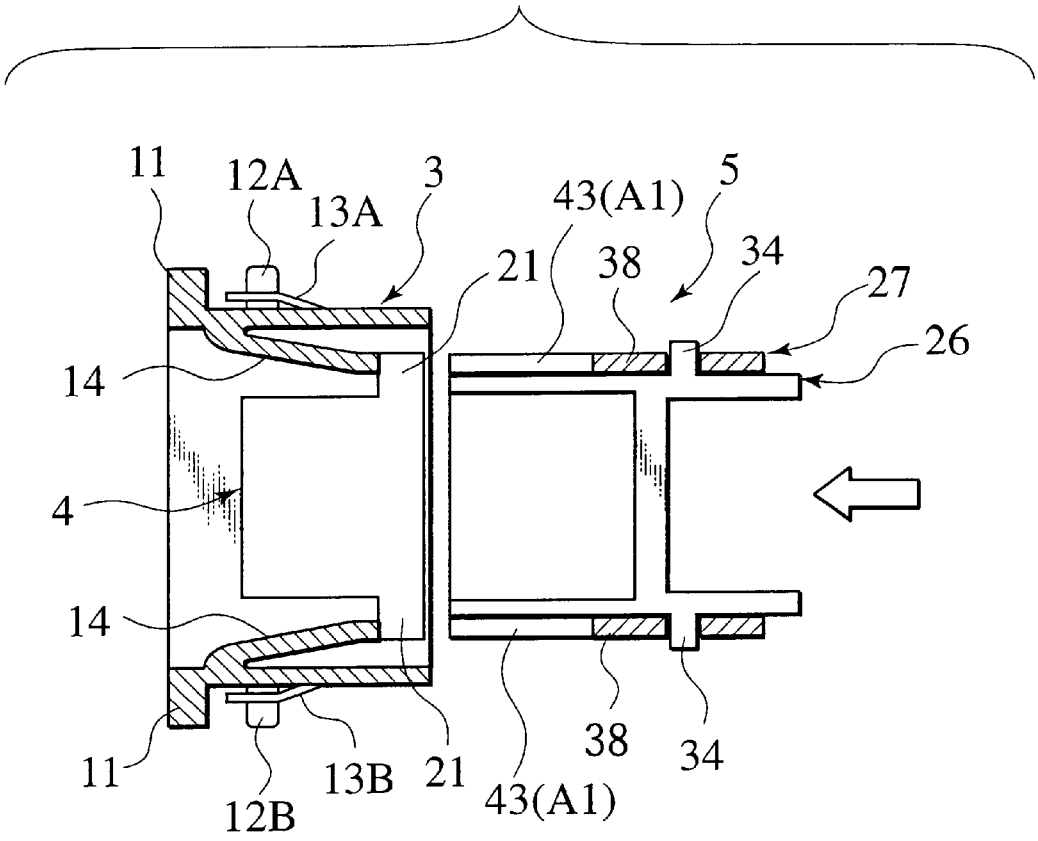
FIG. 25 is a sectional view taken along a 25—25 line in FIG. 24.

First, the bracket 3 is mounted to the bracket locking opening 9 formed in the mounted member 2 of the instrument panel 1 by the above-described method. The female connector 4 is temporarily locked to the bracket 3. That is, the stopper 23 of the female connector housing 18 is inserted into the tip end of the female connector 4 from the opening of the bracket 3 on the side of the base end, and is fitted until the stopper 23 abuts the stopper receiver 25 of the bracket 3. As a result, as shown in FIGS. 24 and 25, the boss 21 of the female connector housing 18 rides over the temporarily locking arm 14, and the tip end of the temporarily locking arm 14 abuts the side surface of the boss 21, and the female connector 4 is temporarily locked. The operation step for temporarily locking the female connector 4 to the bracket 3 may be carried out before or after the operation step for mounting the bracket 3 to the instrument panel 1.

Next, an operation method for coupling the male connector 5 and the female connector 4 which was temporarily locked to the instrument panel 1 through the bracket 3 will be explained.

As shown in FIG. 24, the tip end surface of the male connector 5 provided on the side of the equipment is brought to be opposed to the tip end surface of the female connector 4 which was temporarily locked to the bracket 3, and the male connector 5 is allowed to approach the female connector 4. At that time, the cam lever 27 is disposed at the initial state position. That is, the side edge 42 formed with the cam groove 43 in the lever plate 38 is set such that the cam groove 43 is substantially in parallel to the front end edge of the male connector 5. The lever temporarily locking piece 40 is temporarily locked to the male connector housing 26, and the initial state position of the cam lever 27 is maintained. If the male connector 5 abuts the female connector housing 18, the boss 21 protruding from the female connector housing 18 is inserted into an entrance of the boss introducing region A1 of the cam groove 43. This state shows a state in which the bracket 3 is temporarily locks the female connector 4 with the temporarily locking arm 14, and a state in which the boss introducing region A1 of the cam groove 43 can pick up the boss 21.

Figure 26:
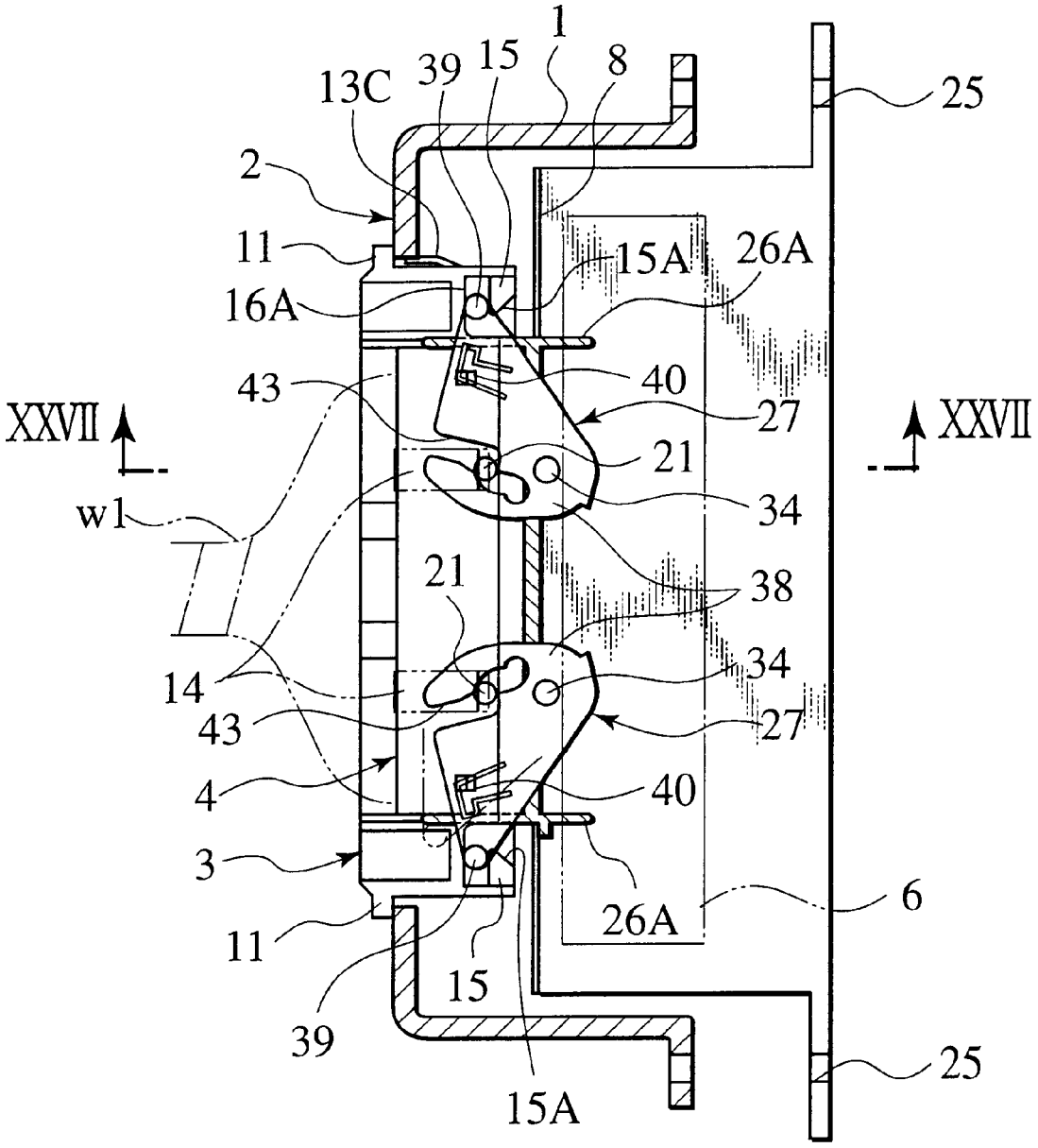
FIG. 26 is a partial sectional view showing a state in which the male connector is fitted to the female connector, and a boss is located at a terminal portion of a boss introducing region of a cam groove.
Figure 27:
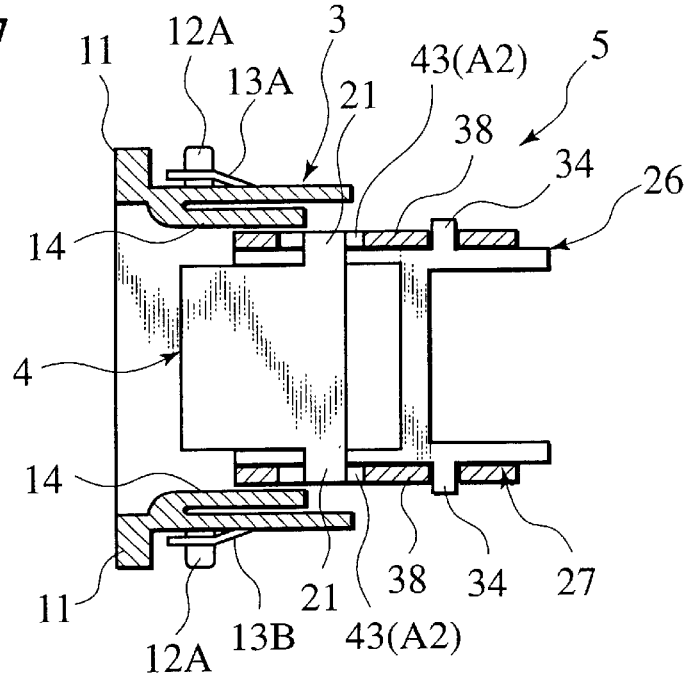
FIG. 27 is a sectional view taken along a 27—27 line in FIG. 26.

Next, as shown in FIGS. 26 and 27, the male connector 5 is further pushed into the fitting direction to the female connector 4, the turning operation portion 39 of the cam lever 27 is guided by the guide slant 15A of the lever-separating force applying protrusion 15 and abuts the step 16A. If the male connector 5 is further pushed into the fitting direction, the turning operation portion 39 moves outward along the abutment surface of the step 16A and enters into a back side of the lever-separating force applying protrusion 15, and receives a reaction force for pushing the turning operation portion 39 rearward of the male connector housing 26 around the contact portion with the step 16A as a point of force. This reaction force applies a force for turning the cam lever 27 around the lever mounting shaft 34 as a fulcrum.

As a result, the lever plate 38 of the cam lever 27 starts turning to release the temporary locking between the lever temporarily locking piece 40 and the male connector housing 26. In addition, as the cam lever 27 turns, a predetermined portion of the lever plate 38 acts such as to separate, from the female connector housing 18, the temporarily locking arm 14 on the side of the bracket 3 which temporarily locked the female connector housing 18 behind the boss 21. As a result, the temporarily locking state between the female connector 4 and the bracket 3 is released, and the female connector 4 and the cam lever 27 of the male connector 5 are brought into a state in which they are held only by engagement therebetween. Since the female connector 4 is brought into a free state from the bracket 3 and the instrument panel 1, the moving distance in the fitting direction of the male connector 5 is not restricted by the female connector 4. Therefore, the rotation stroke and rotation angle of the cam lever 27 can be set great, and the servo action (which will be described later) can be increased. That is, even if the length of the arm of the moment generated by the reaction force that the turning operation portion 39 receives is largely increased as compared with a length between the lever mounting shaft 34 and the servo operation region A2 of the cam groove 43, the rotation stroke and rotation angle can be set great. Therefore, it is possible to amplify the servo force in the servo operation region A2.

Figure 28:
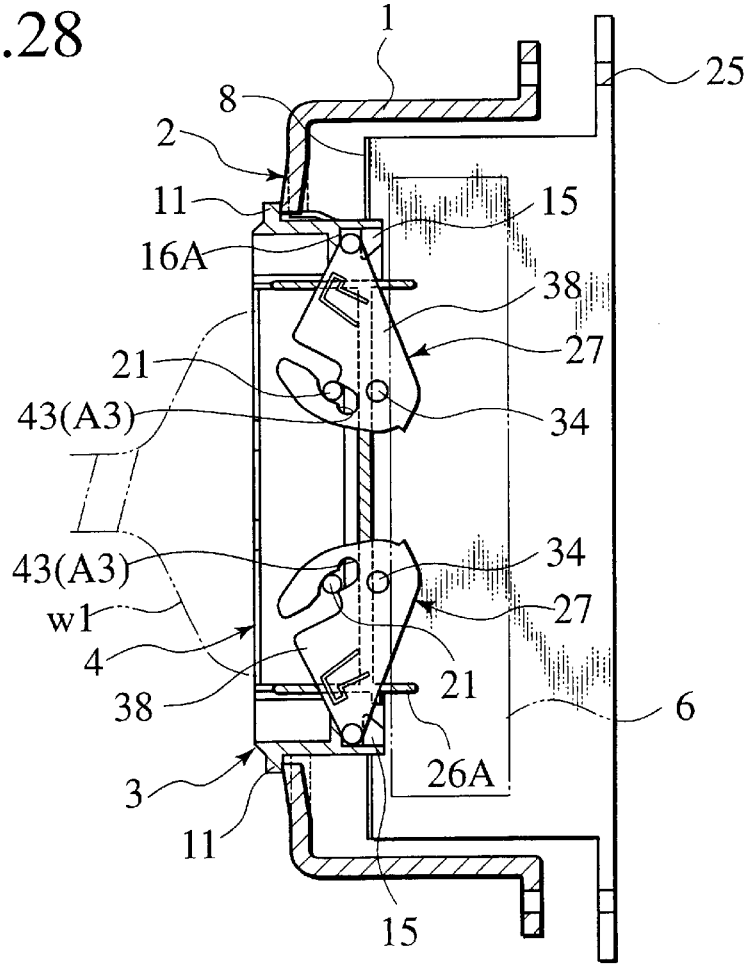
FIG. 28 is a partial sectional view showing a state in which the male connector is fitted to the female connector, and the boss is located in a servo operation region of the cam groove.

This servo operation region A2 has a function for forcibly bringing the boss 21 closer toward the lever mounting shaft 34 by the servo force because of the grove shape gradually approaching the lever mounting shaft 34. As a result, even if a force for pushing the male connector 5 side is weak, it is possible to reliably bring the boss 21 closer to the lever mounting shaft 34 by the servo force to facilitate the fitting state of the male connector 5 and the female connector 4. FIGS. 26 and 27 show a state in which the boss 21 is located within the servo operation region A2 of the cam groove 43. FIG. 28 shows a halfway fitting state of the male connector 5 to the female connector 4, and shows a state in which the boss 21 is moving from the servo operation region A2 in the cam groove 43 toward the idling operation region A3. In the state shown in FIG. 28, as the male connector 5 is pushed, since the turning operation portion 39 of the cam lever 27 pushes the step 16A, the instrument panel 1 near the mounted member 2 is bent rearward as shown in FIG. 28.

Figure 29:
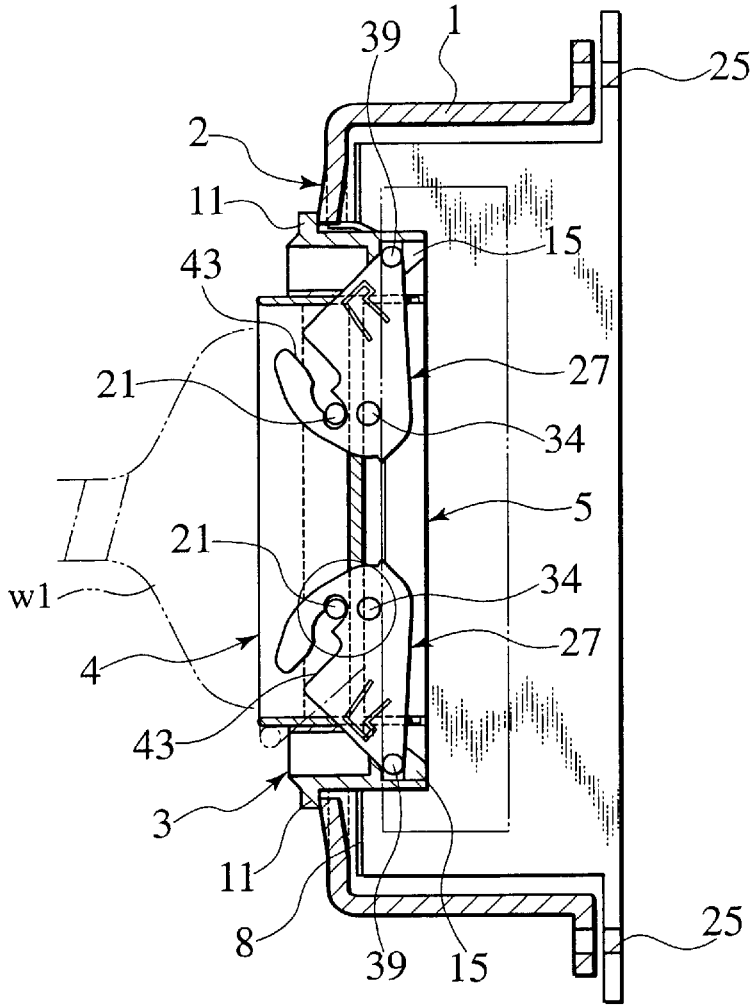
FIG. 29 is a partial sectional view showing a state in which the male connector is fitted to the female connector, and the boss is located in a terminal portion of the servo operation region of the cam groove.
Figure 30:
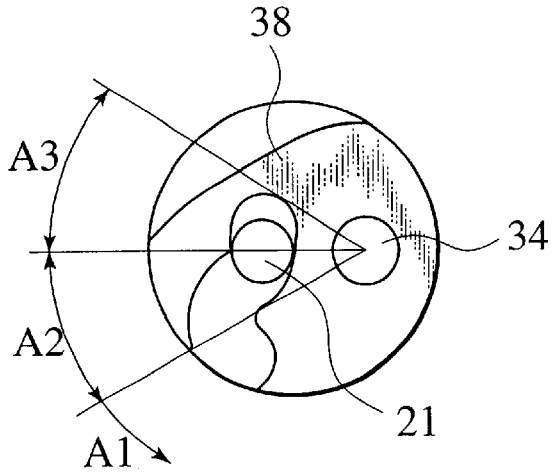
FIG. 30 is an enlarged view of a circle portion surrounding peripheries of a boss 21 and a lever mounting shaft 34 shown in FIG. 29.

Next, if the male connector 5 is further pushed, as shown in FIG. 29, the male connector 5 is completely fitted to the female connector 4 and reliable coupling is completed. That is, as shown in FIG. 30, the boss 21 protruding from the female connector housing 18 passes through a terminal point of the servo operation region A2 in the cam groove 43 of the lever plate 38, and reaches the entrance of the idling operation region A3. As of this point in time, the instrument panel 1 near the mounted member 2 is bent rearward like the state shown in FIG. 28.

Figure 31:
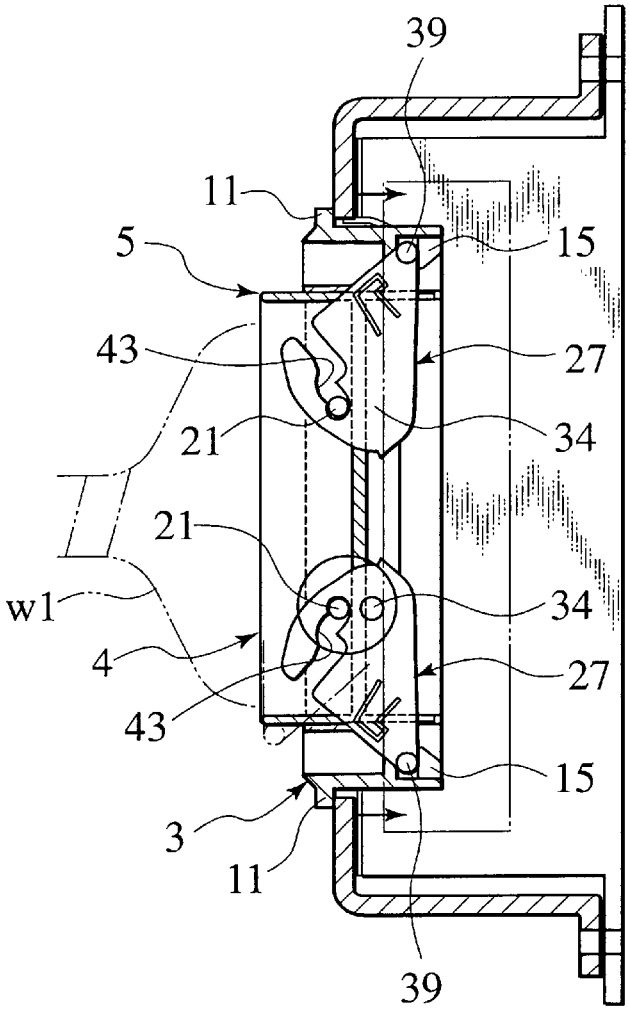
FIG. 31 is a partial sectional view showing a state in which the male connector is fitted to the female connector, and the boss moves in an idling operation region of the cam groove.
Figure 32:
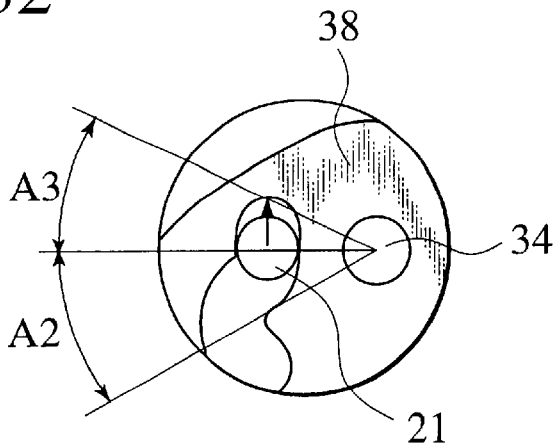
FIG. 32 is an enlarged view of a circle portion surrounding peripheries of a boss 21 and a lever mounting shaft 34 shown in FIG. 31.

As described above, at the time point in which the boss 21 passed through the terminal point of the servo operation region A2 and reached the entrance of the idling operation region A3, the instrument panel 1 near the mounted member 2 is bent rearward. However, after that, the bending of the instrument panel 1 is instantaneously returned by the resilient force, and the turning operation portion 39 of the cam lever 27 is turned rearward as shown in FIG. 31. At that time, the position of the male connector 5 is not changed. In this state, the cam lever 27 (lever plate 38) turns within a range of the idling operation region A3. The boss 21 in the idling operation region A3 only moves relatively in the idling operation region-A3 without receiving a force from the cam lever 27 side. That is, since the idling operation region A3 is formed along the circumference having a center axis at the lever mounting shaft 34 (pivot hole 41), the boss 21 does not receive any force by the turning motion of the cam lever 27. The bending return of the instrument panel 1 is absorbed by the relative movement of the boss 21 in the idling operation region A3 as shown in FIG. 32, and the bending return does not affect the fitting between the male connector 5 and the female connector 4.

Figure 33:
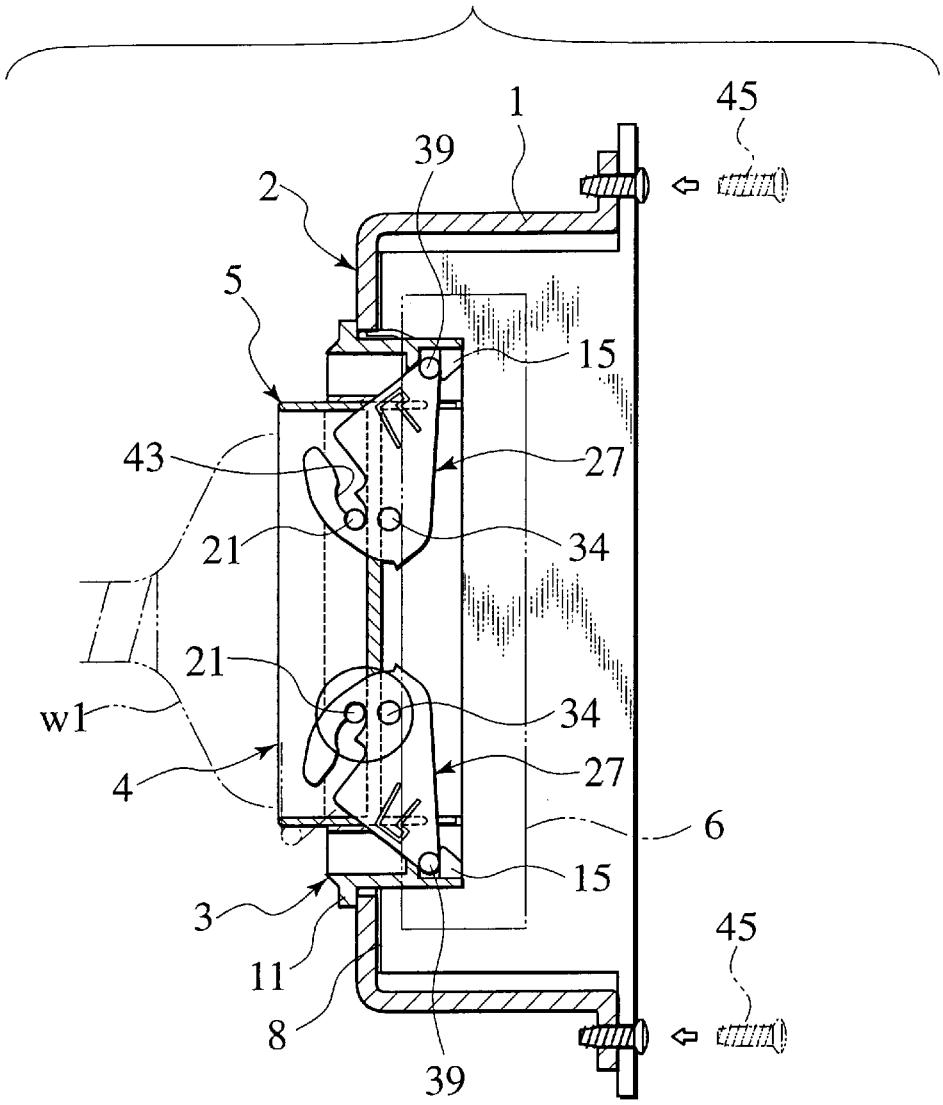
FIG. 33 is a partial sectional view showing a state in which the male connector is completely fitted to the female connector, the boss moves in the idling operation region of the cam groove and a bending of the instrument panel is absorbed.
Figure 34:
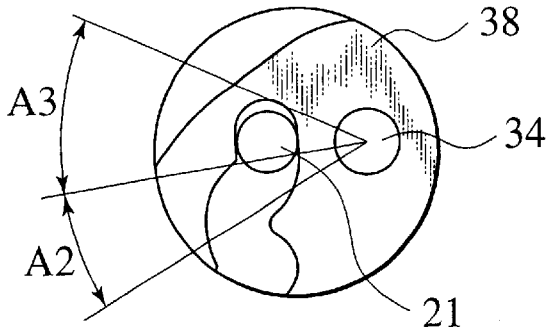
FIG. 34 is an enlarged view of a circle portion surrounding peripheries of a boss 21 and a lever mounting shaft 34 shown in FIG. 33.

FIGS. 33 and 34 show a state in which the female connector 4 and the male connector 5 were completely coupled to each other and the bending of the instrument panel 1 was returned. In this state, the boss 21 is located in the idling operation region A3 of the cam groove 43, and the fitting state between the female connector 4 and the male connector 5 is not affected by slight swinging of the cam lever 27. Then, finally, as shown in FIG. 33, the equipment side and the instrument panel 1 side are fixed to each other using screws 45, and the assembling operation of the connector support mechanism is completed.

Next, a releasing operation of the connection between the female connector 4 and the male connector 5 assembled in the above-described manner will be explained.

In order to release the connection between the female connector 4 and the male connector 5 from the state shown in FIG. 33, the screws 45 are first removed. Further, the equipment side in which the male connector 5 is provided is pulled backward in the direction opposite from the fitting direction. Then, the female connector 4 and the male connector 5 start moving toward the equipment. Since the turning operation portion 39 of the cam lever 27 abuts the separation force applying surface 15B (see FIG. 9) of the lever-separating force applying protrusion 15, the cam lever 27 is rotated in a direction (separating direction) opposite from the fitting direction around the lever mounting shaft 34 as a fulcrum as the male connector 5 is retreated. With this movement, the boss 21 which was located in the idling operation region A3 of the cam groove 43 moves to the servo operation region A2 as the cam lever 27 is rotated.

If the male connector 5 is retreated from this state, the boss 21 in the servo operation region A2 starts moving toward the boss introducing region A1. With this movement, the contact portion between the turning operation portion 39 of the cam lever 27 and the separation force applying surface 15B acts as a point of force, the lever mounting shaft 34 acts as a fulcrum, and the boss 21 receives a servo force in the servo operation region A2. As a result, by retreating the male connector 5 side with a slight force, it is possible to forcibly release the fitting state between the female connector 4 and the male connector 5. Simultaneously with the release of the fitting state between the female connector 4 and the male connector 5, the contact between the lever plate 38 and the temporarily locking arm 14 which was deformed and disposed at the releasing position by the force from the lever plate 38 is released and the temporarily locking arm 14 is returned, and the temporarily locking arm 14 again holds the female connector housing 18.

If the position of the boss 21 moves from the servo operation region A2 in the cam groove 43 to the boss introducing region A1 by the retreating movement of the male connector 5, since the boss introducing region A1 is of substantially straight groove shape, it is possible to easily move the boss 21 outward from the cam groove 43. At that time, since the fitting degree between the female connector 4 and the male connector 5 is shallow, a force for retreating the male connector 5 may be extremely small. If the fitting state between the female connector 4 and the male connector 5 was released, the turning operation portion 39 of the cam lever 27 can freely turn toward the front end of the male connector 5. Therefore, it is possible to shorten the distance between the turning operation portions 39 and 39 of both the cam levers 27 and 27, the turning operation portions 39 and 39 can be taken out from the gap between the lever-separating force applying protrusion 15 and the male connector housing 26, and the female connector 4 and the male connector 5 can be separated completely. In this state also, since the female connector 4 is again temporarily locked to the bracket 3, the female connector 4 should not drop from the instrument panel 1.

In the connector support mechanism of the above embodiment, when the female connector 4 is temporarily locked to the bracket 3, and the female connector 4 and the male connector 5 start fitting to each other, the locked state of the female connector 4 to the bracket 3 is released so that a stroke of the male connector 5 in the fitting direction can be made longer. Since the turning operation portion 39 of the cam lever 27 is positioned and fixed by the step 16A of the lever capturing protrusion 16 on the side of the bracket 3, it is possible to increase the rotation angle of the cam lever 27 by the long stroke of the male connector 5 in the fitting direction. By increasing the rotation amount of the cam lever 27, the servo operation region A2 formed on the cam groove 43 can be formed into a shape in which an arc drawn by the servo operation region A2 gradually approaches the lever mounting shaft 34 (pivot hole 41). Therefore, it is possible to reduce a force (fitting load) for pushing out the male connector 5. Thus, it is possible to easily couple the female connector 4 and the male connector 5 by positioning the front end surfaces of both the connectors 4 and 5.

In the state in which the female connector 4 and the male connector 5 are fitted to each other, since the female connector 4 is not supported on the side of the instrument panel 1 (since the temporarily locked state by the bracket 3 is not released), it is possible to restrain the vibration from being transmitted from the instrument panel 1 side to the female connector 4. Therefore, it is possible to restrain the relative vibration caused by weight difference between the instrument panel 1 and the equipment side (male connector 5 side) from affecting the coupled portion between the connectors. Further, excellent electrical coupling generating not noise or connection failure can be realized.

In addition, since the bracket 3 establishes the temporarily locking utilizing the temporarily locks the boss 21 protruding from the female connector housing 18, it is unnecessary to add special structure to the female connector housing 18, and the structure of the female connector 4 can be simplified.

Further, when the male connector 5 approaches the female connector 4, the guide slants 15A and 15A of the lever-separating force applying protrusions 15 provided on opposite sides of the front end of the bracket 3 which temporarily locks the female connector 4 pick us the turning operation portions 39 and 39 of both the cam levers 27 and 27, and a so-called alignment function for optimizing the position of the front end surface of the male connector 5 is performed. Therefore, the connectors can easily and reliably be fitted to each other by abutting the male connector 5 against the bracket 3.

When the connection between the female connector 4 and the male connector 5 is released from their coupled state, they can easily be separated with a slight force. When the male connector 5 is pulled out, since the turning operation portion 39 of the cam lever 27 abuts the separation force applying surface 15B of the lever-separating force applying protrusion 15, a force for pulling out the male connector 5 is applied to the turning operation portion 39 with the abutment portion as a point of force. Therefore, the cam lever 27 turns around the lever mounting shaft 34 as a fulcrum. A portion at which the boss 21 and the inner side wall of the servo operation region A2 of the cam groove 43 abut each other functions as a point of application, the boss 21 receives the servo force and is forcibly moved in a direction separating away from the male connector 5. A distance between the lever mounting shaft 34 (fulcrum) and the turning operation portion 39 (a point of force) is largely shorter than a distance between the lever mounting shaft 34 (fulcrum) and the servo operation region A2 (a point of application). Therefore, the boss 21 receives the servo force and is driven in a direction separating away from the male connector 5.

Further, since the bending of the instrument panel 1 generated when the male connector 5 is fitted is absorbed by the idling operation region A3 formed on the cam lever 27, it is possible to prevent unnecessary load from being applied to the connector. Therefore, it is possible to realize a connector support mechanism having high mechanical reliability suitable of actual assembling place.

Although the embodiment has been explained above, the present invention is not limited to this, and the invention can variously be modified coming with subject matter of the structure.

For example, although the b13 is formed with the panel holding protrusions 12A and 12B, and the locking pawls 13A, 13B and 13C so that the bracket 3 can be mounted to the instrument panel 1 in one-touch manner in the above embodiment, the bracket 3 may be fixed to the instrument panel 1 using fixing means such as a screw.

Further, the female connector 4 is temporarily locked to the bracket 3 and the male connector 5 is provided on the side of the equipment in the above embodiment, the male connector 5 may be temporarily locked to the bracket 3 and the equipment side may be provided with the female connector 4. In this case, it is necessary to mount the cam lever to the female connector 4.

Further, the male connector 5 is fixed to the board 6 on the side of the equipment in the above embodiment, the male connector 5 may be connected to the equipment side through wire harness, only the male connector 5 may connected to the female connector 4 and then, the equipment side may be fixed to the instrument panel 1.

What is claimed is:

1. A connector support mechanism for interconnecting connectors, comprising:

a bracket configured to be mounted to a plate body and comprising a temporarily locking arm;

a first connector comprising a guide protrusion and configured to be temporarily locked to the bracket by abutting the guide protrusion against the temporarily locking arm;

a second connector rotatably supporting a cam lever having a cam groove for guiding the guide protrusion and configured to rotate about a pivot point, the cam lever configured to release the temporarily locked first connector from the bracket by rotating about the pivot point, wherein, by engaging the guide protrusion in the cam groove, the temporarily locked first connector is released from the bracket, and the first connector and the second connector are fitted to each other.

2. A connector support mechanism according to claim 1, wherein a portion of the cam groove is configured to guide the guide protrusion for releasing the temporarily locked first connector from the bracket, when the first connector and the second connector are fitted to each other.

3. A connector support mechanism according to claim 1, wherein the bracket is substantially cylindrical and fixed secured to an opening of the plate body.

4. A connector support mechanism according to claim 1, wherein the temporarily locking arm is formed on an inner surface of the bracket protruding forwardly toward the direction of the second connector.

5. A connector support mechanism according to claim 1, wherein:

the cam lever comprises a turning operation portion configured to abut the bracket as the first and second connectors are engaged to each other, and the bracket includes a locking step for locking the turning operation portion to the bracket.

6. A connector support mechanism according to claim 1, wherein:

the cam lever comprises a turning operation portion configured to abut the bracket as the first and second connectors are engaged to each other, and the cam lever is configured to rotate as the first and second connectors are engaged, so that the turning operation member of the came lever is locked to the bracket.

7. A connector support mechanism according to claim 1, wherein:

the cam lever comprises a turning operation portion configured to abut the bracket as the first and second connectors are engaged to each other, and a distance between the turning operation portion and the pivot portion is set longer than a distance between the pivot portion and any portion in the cam groove.

8. A connector support mechanism according to claim 1, wherein the cam groove comprises:

a guide protrusion introducing region formed on an edge of the cam lever;

a servo operation region formed continuously with the guide protrusion introducing region for moving the guide protrusion as the cam lever rotates; and an idling operation region formed continuously with the servo operation region for allowing relative movement of the guide protrusion caused by the plate body being bent and returned.

* * * * *

UNITED STATES PATENT AND TRADEMARK OFFICE

CERTIFICATE OF CORRECTION

PATENT NO. : 6,428,353 B2
DATED : August 6, 2002
INVENTOR(S) : Shinji Mochizuki

It is certified that error appears in the above-identified patent and that said Letters Patent is hereby corrected as shown below:

Column 16,
Line 7, “fixed” should read -- fixedly” --.
Line 28, “came” should read -- cam --.

Signed and Sealed this

Twenty-eighth Day of January, 2003

JAMES E. ROGAN
*Director of the United States Patent and Trademark Office*